US008785101B2

(12) United States Patent
Kaya et al.

(10) Patent No.: US 8,785,101 B2
(45) Date of Patent: Jul. 22, 2014

(54) TONER

(71) Applicant: Canon Kabushiki Kaisha, Tokyo (JP)

(72) Inventors: Takaaki Kaya, Suntou-gun (JP); Tetsuya Kinumatsu, Numazu (JP); Toshifumi Mori, Suntou-gun (JP); Ayako Okamoto, Wako (JP); Kenji Aoki, Mishima (JP); Shuntaro Watanabe, Hadano (JP); Atsushi Tani, Suntou-gun (JP); Takashige Kasuya, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/741,356

(22) Filed: Jan. 14, 2013

(65) Prior Publication Data

US 2013/0130168 A1 May 23, 2013

Related U.S. Application Data

(63) Continuation of application No. PCT/JP2012/064334, filed on Jun. 1, 2012.

(30) Foreign Application Priority Data

Jun. 3, 2011 (JP) ..... 2011-125760

(51) Int. Cl.
*G03G 9/00* (2006.01)

(52) U.S. Cl.
USPC ..... 430/119.2; 430/109.1; 430/109.4; 430/119.1; 430/137.1

(58) Field of Classification Search
USPC ..... 430/119.2, 109.4, 109.1, 137.1, 119.1
See application file for complete search history.

(56) References Cited

U.S. PATENT DOCUMENTS

| | | | |
|---|---|---|---|
| 5,135,833 | A | 8/1992 | Matsunaga et al. |
| 5,147,750 | A | 9/1992 | Nakanishi |
| 5,298,354 | A | 3/1994 | Matsunaga et al. |
| 5,300,386 | A | 4/1994 | Kanbayashi et al. |
| 5,354,639 | A | 10/1994 | Kasuya et al. |
| 5,354,640 | A | 10/1994 | Kanbayashi et al. |
| 5,407,776 | A | 4/1995 | Kanbayashi et al. |
| 5,478,686 | A | 12/1995 | Kawakami et al. |
| 5,500,321 | A | 3/1996 | Kasuya et al. |
| 5,529,873 | A | 6/1996 | Chiba et al. |
| 5,558,967 | A | 9/1996 | Nagatsuka et al. |
| 5,571,653 | A | 11/1996 | Kasuya et al. |
| 5,578,407 | A | 11/1996 | Kasuya et al. |
| 5,691,093 | A | 11/1997 | Kanbayashi et al. |
| 5,700,616 | A | 12/1997 | Kasuya et al. |
| 5,712,073 | A | 1/1998 | Katada et al. |
| 5,736,288 | A | 4/1998 | Kasuya et al. |
| 5,814,429 | A | 9/1998 | Kawakami et al. |
| 5,840,457 | A | 11/1998 | Urawa et al. |
| 5,972,553 | A | 10/1999 | Katada et al. |
| 6,002,895 | A | 12/1999 | Kasuya et al. |
| 6,214,509 | B1 | 4/2001 | Kasuya et al. |
| 6,300,024 | B1 | 10/2001 | Yusa et al. |
| 6,485,875 | B1 | 11/2002 | Karaki et al. |
| 6,586,151 | B1 | 7/2003 | Naka et al. |
| 6,664,016 | B2 | 12/2003 | Kanbayashi et al. |
| 6,703,176 | B2 | 3/2004 | Naka et al. |
| 6,751,424 | B2 | 6/2004 | Komatsu et al. |
| 6,875,549 | B2 | 4/2005 | Yamazaki et al. |
| 6,881,527 | B2 | 4/2005 | Moribe et al. |
| 6,905,808 | B2 | 6/2005 | Itakura et al. |
| 7,001,703 | B2 | 2/2006 | Moribe et al. |
| 7,014,969 | B2 | 3/2006 | Yachi et al. |
| 7,097,951 | B2 | 8/2006 | Moribe et al. |
| 7,147,980 | B2 | 12/2006 | Itakura et al. |
| 7,150,953 | B2 | 12/2006 | Yamazaki et al. |
| 7,229,727 | B2 | 6/2007 | Itakura et al. |
| 7,238,387 | B2 | 7/2007 | Ogawa et al. |
| 7,244,539 | B2 | 7/2007 | Baba et al. |
| 7,262,262 | B2 * | 8/2007 | Matsumura et al. ..... 528/272 |
| 7,267,919 | B2 | 9/2007 | Moribe et al. |
| 7,273,686 | B2 | 9/2007 | Onuma et al. |
| 7,288,354 | B2 | 10/2007 | Moribe et al. |

(Continued)

FOREIGN PATENT DOCUMENTS

| | | | |
|---|---|---|---|
| JP | 3-15079 | A | 1/1991 |
| JP | 11-95482 | A | 4/1999 |

(Continued)

OTHER PUBLICATIONS

Span, et al., "A New Equation of State for Carbon Dioxide Covering the Fluid Region from the Triple-Point Temperature to 1100 K at Pressures up to 800 MPa", Journal of Physical and Chemical Reference Data, vol. 25, No. 6, 1996, pp. 1509-1596.
Kinumatsu, et al., U.S. Appl. No. 13/741,369, filed Jan. 14, 2013.
Watanabe, et al., U.S. Appl. No. 13/741,359, filed Jan. 14, 2013.
Aoki, et al., U.S. Appl. No. 13/741,372, filed Jan. 14, 2013.
PCT International Search Report and Written Opinion of the International Searching Authority, International Application No. PCT/JP2012/064334, Mailing Date Aug. 7, 2012.
English Translation of International Preliminary Report on Patentability, International Application No. PCT/P2012/064334, Mailing Date Dec. 19, 2013.

*Primary Examiner* — Thorl Chea
(74) *Attorney, Agent, or Firm* — Fitzpatrick, Cella, Harper and Scinto

(57) ABSTRACT

Provided is a toner containing toner particles, each of which includes a binder resin containing a polyester as a main component, a colorant, and a wax, in which the binder resin includes a block polymer in which a segment capable of forming a crystalline structure and a segment incapable of forming a crystalline structure are bonded, the toner has a maximum endothermic peak from the binder resin, as determined by differential scanning calorimetry measurement, with a peak temperature in a specific range and with an endothermic quantity in a specific range, and the wax is an ester wax having a functionality of 3 or more.

9 Claims, 4 Drawing Sheets

(56) References Cited

U.S. PATENT DOCUMENTS

| | | | |
|---|---|---|---|
| 7,361,441 | B2 | 4/2008 | Itakura et al. |
| 7,402,368 | B2 | 7/2008 | Ogawa et al. |
| 7,422,832 | B2 | 9/2008 | Ogawa et al. |
| 7,452,649 | B2 | 11/2008 | Magome et al. |
| 7,537,877 | B2 | 5/2009 | Yoshiba et al. |
| 7,582,401 | B2 | 9/2009 | Ogawa et al. |
| 7,678,524 | B2 | 3/2010 | Hasegawa et al. |
| 7,700,254 | B2 | 4/2010 | Moribe et al. |
| 7,704,659 | B2 | 4/2010 | Ogawa et al. |
| 7,776,501 | B2 | 8/2010 | Tamura et al. |
| 7,794,908 | B2 | 9/2010 | Kaya et al. |
| 7,794,909 | B2 | 9/2010 | Kaya et al. |
| 7,811,734 | B2 | 10/2010 | Ogawa et al. |
| 7,935,771 | B2 | 5/2011 | Fukui et al. |
| 7,939,231 | B2 | 5/2011 | Ogawa et al. |
| 7,943,281 | B2 | 5/2011 | Kaya et al. |
| 8,084,174 | B2 | 12/2011 | Hasegawa et al. |
| 8,093,342 | B2 | 1/2012 | Minami et al. |
| 8,110,329 | B2 | 2/2012 | Tominaga et al. |
| 8,178,275 | B2 | 5/2012 | Tani et al. |
| 8,362,197 | B2 | 1/2013 | Shindo et al. |
| 8,372,573 | B2 | 2/2013 | Ayaki et al. |
| 8,383,312 | B2 | 2/2013 | Fujimoto et al. |
| 2005/0208398 | A1 | 9/2005 | Ohmura et al. |
| 2006/0263711 | A1 | 11/2006 | Yuasa et al. |
| 2007/0092823 | A1 | 4/2007 | Matsumura et al. |
| 2008/0050669 | A1 | 2/2008 | Ohmura et al. |
| 2008/0268368 | A1 | 10/2008 | Yuasa et al. |
| 2008/0286675 | A1 | 11/2008 | Tani et al. |
| 2010/0062355 | A1 | 3/2010 | Kaya et al. |
| 2010/0173241 | A1* | 7/2010 | Ieda ..... 430/108.4 |
| 2011/0039200 | A1 | 2/2011 | Kaya et al. |
| 2011/0045398 | A1 | 2/2011 | Sekikawa et al. |
| 2011/0136054 | A1 | 6/2011 | Watanabe et al. |
| 2011/0300478 | A1 | 12/2011 | Sekikawa et al. |
| 2012/0021348 | A1* | 1/2012 | Kaya et al. ..... 430/109.4 |
| 2012/0171607 | A1 | 7/2012 | Ayaki et al. |
| 2012/0231384 | A1 | 9/2012 | Aoki et al. |

FOREIGN PATENT DOCUMENTS

| | | | |
|---|---|---|---|
| JP | 2002-287405 | A | 10/2002 |
| JP | 2003-302785 | A | 10/2003 |
| JP | 2004-191927 | A | 7/2004 |
| JP | 2005-3883 | A | 1/2005 |
| JP | 2005-24863 | A | 1/2005 |
| JP | 2005-215253 | A | 8/2005 |
| JP | 2006-3513 | A | 1/2006 |
| JP | 2006-276293 | A | 10/2006 |
| JP | 2007-114635 | A | 5/2007 |
| JP | 2008-52192 | A | 3/2008 |
| JP | 2009-168915 | A | 7/2009 |
| JP | 2010-168529 | A | 8/2010 |
| WO | 2005/013012 | A1 | 2/2005 |

* cited by examiner

TONER

This application is a continuation of International Application No. PCT/JP2012/064334, filed Jun. 1, 2012, the contents of which are incorporated by reference herein.

BACKGROUND OF THE INVENTION

1. Field of the Invention

The present invention relates to a toner for use in an image-forming method which utilizes electrophotographic technology, electrostatic recording technology or toner jet recording technology.

2. Description of the Related Art

How to implement energy savings in electrophotographic equipment has become a major technical concern in recent years. One solution has been to cut down markedly on the quantity of heat applied to the fixing apparatus. This has led to an increased need in toners for "low-temperature fixability" which enables fixing to occur at a lower energy.

One method that is known to be effective for enabling fixing to occur at lower temperatures is to make the binder resin sharper melting. It is in this connection that toners which use crystalline polyester resins have been proposed. Because crystalline polyesters, owing to the arrangement of the molecular chain, do not exhibit a distinct glass transition and do not readily soften up to the crystal melting point, they are being investigated as materials which are capable of achieving both heat-resistant storage stability and low-temperature fixability.

However, when a crystalline polyester is used alone as the toner binding resin, the toner has a sharp melting property, but lacks elasticity at elevated temperatures, as a result of which hot offset and a decrease in the degree of gloss due to penetration into the paper may arise and the fixing temperature range may narrow. Hence, in continuous image formation under a low-temperature environment in a printer, offset and uneven gloss have tended to arise, preventing stable images from being obtained.

Therefore, toners have been proposed in which a smaller amount of crystalline polyester is added and crystalline polyester and non-crystalline polyester are used in admixture.

Japanese Patent Application Laid-open No. 2004-191927 attempts to enhance the fixing latitude by controlling the storage elastic modulus and loss elastic modulus at the melting point+20° C. in a capsule-type toner containing a crystalline polyester and a non-crystalline polyester.

In cases where a small amount of crystalline polyester is added to non-crystalline polyester, this changes the viscosity of the non-crystalline polyester, enabling the viscosity at high temperatures to be adjusted and thus making it possible to suppress hot offset. However, in such cases, the sharp melt properties of the crystalline polyester are not fully exhibited, making it impossible to fully manifest the effects on the low-temperature fixability.

To resolve such problems, toners have been proposed which make use of a binder resin composed of a crystalline polyester and a non-crystalline polyester that are block copolymerized.

Japanese Patent Application Laid-open No. 2007-114635 shows that, by using a block copolymer obtained by the esterification of crystalline polyester blocks and non-crystalline polyester blocks, fixing by low-temperature heating is possible.

Japanese Patent Application Laid-open No. 2008-052192 shows that a toner of improved heat-resistant storage stability and hot offset resistance is achieved with a urea-modified polyester obtained by using an amino crosslinking agent to modify crystalline polyester segments and amorphous polyester segments.

Japanese Patent Application Laid-open No. 2010-168529 discloses a toner obtained by dispersing, in carbon dioxide in a liquid or supercritical state, an organic solvent solution of a resin composed of crystalline segments which contain as an essential ingredient an aliphatic polyester (i.e., crystalline polyester) and non-crystalline segments so as to form resin particles, then removing the organic solvent and the carbon dioxide.

However, even in cases where toners containing such block polymers are used, with regard to the low-temperature fixability, particularly when the wax dispersibility within the toner is inadequate, there are times where cold offset arises and sufficient effects cannot be obtained. Also, in cases where the crystalline polyester is insufficiently crystallized, the heat-resistant storage stability may be inadequate or, depending on the particular wax used, a decrease in the heat-resistant storage stability may arise on account of wax bleedout or a decline in crystallinity owing to compatible mixture of the crystalline polyester and the wax. In particular, when the toner has stood for a long time in an environment subjected to repeated temperature cycling, degradation in the heat-resistant storage stability has tended to arise. Hence, there exists a desire for an even more improved toner.

SUMMARY OF THE INVENTION

The present invention was arrived at in light of the foregoing problems. It is therefore an object of the invention to provide a toner which contains a resin having crystalline segments of sharp melting properties that are advantageous for low-temperature fixability, which has a broad fixing latitude in low-temperature to high-temperature regions, and which moreover has a high heat-resistant storage stability. The invention also sets out to, even when using a wax of improved dispersibility, prevent bleedout of the wax, suppress a decline in crystallinity owing to compatible mixture of the crystalline segments and the wax, and improve heat-resistant storage stability.

The toner of the present invention contains toner particles, each of which includes a binder resin containing a polyester as a main component, a colorant, and a wax. The binder resin includes a block polymer in which a segment capable of forming a crystalline structure and a segment incapable of forming a crystalline structure are bonded. In measurement of the toner with a differential scanning calorimetry (DSC), a peak temperature of a maximum endothermic peak derived from the binder resin is at least 50° C. and not more than 80° C., and an endothermic quantity of the maximum endothermic peak is at least 30 J/g and not more than 100 J/g. The wax is an ester wax having a functionality of 3 or more.

The invention is able to provide a toner which contains a resin having crystalline segments of excellent sharp melt properties that is advantageous for low-temperature fixability, yet which has a broad fixing latitude in low-temperature to high-temperature regions and also has a high toner heat-resistant storage stability. Moreover, although a wax of improved dispersibility is used in the toner, bleedout of the wax is prevented and a decline in crystallinity due to compatible mixing of the crystalline segments with the wax is suppressed, enabling the heat-resistant storage stability to be improved.

DESCRIPTION OF THE EMBODIMENTS

Figure 1:
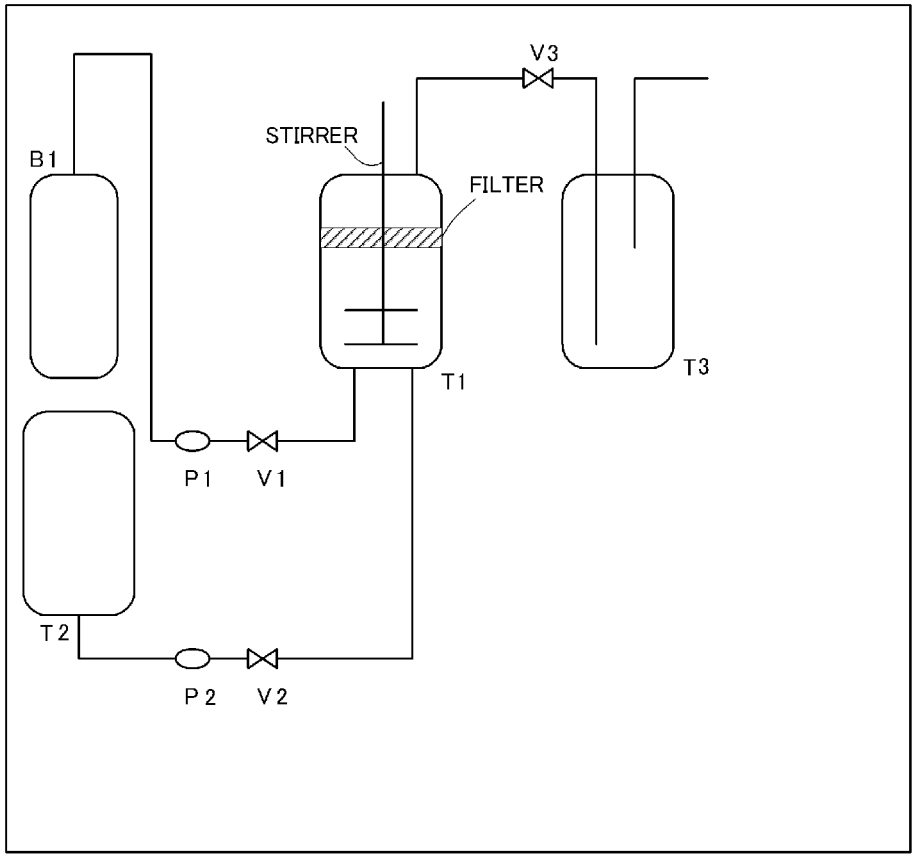
FIG. 1 is a schematic diagram showing a toner manufacturing apparatus.

The toner of the invention is described more fully below for preferred embodiments.

The inventors have conducted investigations on various problems with toners which use the above-described crystalline polyesters. As a result, they have discovered that these problems can be resolved by combination with waxes of a specific structure.

The toner of the invention has toner particles, each of which contains a binder resin containing a polyester as a main component, a colorant, and a wax. The binder resin includes a block polymer in which a segment capable of forming a crystalline structure and a segment incapable of forming a crystalline structure are bonded; in measurement of the toner with a differential scanning calorimetry (DSC), a peak temperature of a maximum endothermic peak derived from the binder resin is at least 50° C. and not more than 80° C., and an endothermic quantity of the maximum endothermic peak is at least 30 J/g and not more than 100 J/g; and the wax is an ester wax having a functionality of 3 or more.

In the invention, the maximum endothermic peak derived from the binder resin, as determined by DSC measurement of the toner, has a peak temperature Tp of at least 50° C. and not more than 80° C. The peak temperature Tp of the maximum endothermic peak from the binder resin can be controlled by changing the peak temperature Tp of the maximum endothermic peak measured by DSC for a group of the segments capable of forming a crystalline structure (also referred to below as the "crystalline segments") which are an essential component of the block polymer included in the binder resin used in the invention. Specifically, the peak temperature Tp can be controlled by the monomer composition and degree of crystallization of the segments capable of forming a crystalline structure. By setting the peak temperature Tp to at least 50° C. and not more than 80° C., it is possible to design a toner having a satisfactory heat-resistant storage stability and low-temperature fixability. The lower limit in the above peak temperature Tp is preferably at least 55° C., and the upper limit in the peak temperature Tp is preferably not more than 70° C.

In the invention, the maximum endothermic peak from the binder resin has an endothermic quantity (ΔH), as determined by DSC measurement of the toner, of at least 30 J/g and not more than 100 J/g. Here, this value ΔH reflects the amount of the crystalline segments existing within the toner that remain in a crystalline state, as a proportion of the overall binder resin. That is, even in cases where numerous crystalline segments have been included within the toner, if the crystallinity is lost, ΔH becomes smaller. Therefore, in toner for which ΔH falls within the above-indicated range, the proportion of crystalline segments that remain present within the toner in a crystalline state is suitable, enabling a good low-temperature fixability to be obtained. If ΔH is smaller than 30 J/g, the proportion within the block polymer of the group of segments incapable of adopting a crystalline structure (also referred to below as the "non-crystalline segments") becomes relatively large, as a result of which the toner is more greatly affected by the glass transition point (Tg) from the non-crystalline segments than by the sharp melt properties of the crystalline segments. This makes it difficult for the toner to exhibit good low-temperature fixability. On the other hand, when ΔH is larger than 100 J/g, the proportion of the crystalline segments becomes large, which tends to impede the dispersion of colorant within the toner and may lead to a decrease in image density. The preferred range for ΔH is at least 35 J/g and not more than 90 J/g.

ΔH can be adjusted by changing the content of the segments capable of forming a crystalline structure, and moreover can be controlled within the above range by subjecting the toner particles to the subsequently described annealing treatment.

In this invention, an ester wax having a functionality of 3 or more is used as the wax. The releasability effects of the wax are thereby exhibited, making it possible to reduce the occurrence of cold offset and to impart an excellent heat-resistant storage stability.

The reason for this is thought to be as follows. The ester wax has an excellent dispersibility in the toner, and is effective for preventing cold offset when fixing is carried out under low-temperature conditions. However, because ester waxes have a structure similar to crystalline resins (e.g., crystalline polyesters), they tend to be compatible with crystalline polyesters. In cases where compatible mixing has occurred, the ester wax has a tendency to enter into the interior of the crystals of crystalline polyester and destroy the crystalline structure of the crystalline polyester. As a result, the crystallinity decreases and the heat resistance tends to be inadequate. In particular, when the toner is left to stand for an extended period of time in an environment subjected to temperature cycling, degradation of the heat-resistant storage stability has tended to arise. Even in cases where the heat-resistant storage stability is satisfactory, maintenance of the static charge sometimes becomes a problem due to wax bleedout.

When use is made of, as in the present invention, an ester wax having a functionality of at least 3, because the wax has a branched structure, compatible mixture with crystalline polyester having a linear structure is difficult, enabling the crystalline structure of the crystalline polyester to be more easily maintained. In this invention, it is more preferable to use an ester wax having a more highly branched structure with a functionality of 4 or more, and still more preferable to use an ester wax having a functionality of 6 or more.

The toner of the invention has, in measurement by gel permeation chromatography (GPC) of the tetrahydrofuran (THF) soluble matter, a number-average molecular weight (Mn) of preferably at least 8,000 and not more than 30,000, and has a weight-average molecular weight (Mw) of preferably at least 15,000 and not more than 60,000. Within these ranges, a suitable viscoelasticity can be imparted to the toner. The Mn is more preferably in the range of at least 10,000 and not more than 25,000, and the Mw is more preferably in the range of at least 25,000 and not more than 50,000. The ratio Mw/Mn is preferably 6 or less, and is more preferably 3 or less.

The toner of the invention contains toner particles, each of which includes a binder resin containing a polyester as a main component, a colorant and a wax. The binder resin includes a block polymer in which a segment capable of forming a crystalline structure and a segment incapable of forming a crystalline structure are bonded.

Here, "a binder resin containing a polyester as a main component" means that polyester segments account for at least 50 mass % of the total amount of the binder resin. The polyester segments in the block polymer are included within the polyester segments described above.

Also, "block polymer" refers to a polymer obtained by using covalent bonds to join the polymer segments together within a single molecule. The phrase "segment capable of forming a crystalline structure" refers to segments which, on collecting together in a large number, are regularly arrayed and exhibit crystallinity, and thus signifies a crystalline polymer chain. In the invention, the crystalline polymer chains are preferably crystalline polyester. The phrase "segment incapable of forming a crystalline structure" refers to segments which, even on collecting together, do not become regularly arrayed, and thus signifies a non-crystalline segment. Such segments refer to non-crystalline polymer chains.

The block polymer may be in any of the following forms wherein a crystalline polymer chain is designated as and a non-crystalline polymer chain is designated as "B": AB-type diblock polymers, ABA-type triblock polymers, BAB-type triblock polymers, and ABAB . . . . -type multiblock polymers. With regard to the type of bond between crystalline polymer chains and non-crystalline polymer chains in the block polymer, urethane bonds are effective for controlling the viscoelasticity of the non-crystalline segments which are collectively the non-crystalline polymer chains, and especially for increasing the viscosity at high temperatures.

In the invention, it is preferable for the crystalline segments which are collectively the segments capable of forming a crystalline structure (crystalline polymer chains) in the block polymer to be a crystalline polyester obtained by reacting an aliphatic dicarboxylic acid with an aliphatic diol.

The crystalline segment is described below for crystalline polyesters by way of illustration, but is not limited only to crystalline polyesters.

The crystalline polyester preferably uses as the starting material an aliphatic diol of at least 4 but not more than 20 carbons and a polycarboxylic acid.

In addition, the aliphatic diol is preferably a linear diol. A linear diol is preferable in that the crystallinity of the polyester can easily be increased.

The aliphatic diol is exemplified by, but not limited to, the following (which may also be used in admixture): 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol. Of these, in terms of the melting point, 1,4-butanediol, 1,5-pentanediol and 1,6-hexanediol are preferred.

Use may also be made of an aliphatic diol having a double bond. Examples of aliphatic diols having a double bond include 2-butene-1,4-diol, 3-hexen-1,6-diol and 4-octen-1,8-diol.

Next, the acid component used to prepare the crystalline polyester is described. The acid component used to prepare the crystalline polyester is preferably a polycarboxylic acid. Aromatic dicarboxylic acids and aliphatic dicarboxylic acids are preferred as the polycarboxylic acid. Of these, aliphatic dicarboxylic acids are more preferred, and linear dicarboxylic acids are even more preferred from the standpoint of crystallinity.

Examples of aliphatic dicarboxylic acids include, but are not limited to, the following (which may also be used in admixture): oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid and 1,18-octadecanedicarboxylic acid, as well as lower alkyl esters and acid anhydrides thereof. Of these, sebacic acid, adipic acid, 1,10-decanedicarboxylic acid, and lower alkyl esters or acid anhydrides thereof are preferred.

Examples of aromatic dicarboxylic acids include terephthalic acid, isophthalic acid, 2,6-naphthalenedicarboxylic acid and 4,4'-biphenyldicarboxylic acid.

Of these, terephthalic acid is preferred because of its ready availability and because it easily forms low-melting polymers.

Use may also be made of a dicarboxylic acid having a double bond. Such dicarboxylic acids, given the ability of the double bond to effect crosslinking of the entire resin, can be advantageously used for preventing high-temperature offset during fixing. Examples of such dicarboxylic acids include, but are not limited to, fumaric acid, maleic acid, 3-hexenedioic acid and 3-octenedioic acid, as well as lower alkyl esters and acid anhydrides thereof. Of these, fumaric acid and maleic acid are preferred in terms of cost.

No particular limitation is imposed on the method of preparing the above crystalline polyester. Preparation may be carried out by an ordinary polyester polymerization process in which an acid component is reacted with an alcohol component. Preparation may be carried out by the selective use of, for example, direct polycondensation or transesterification, depending on the types of monomers used.

Preparation of the crystalline polyester is preferably carried out at a polymerization temperature of at least 180° C. but not more than 230° C. In some cases, it may be preferable to place the reaction system under a reduced pressure and to carry out the reaction while removing water and alcohol generated during condensation. In cases where the monomer does not dissolve or intimately mix at the reaction temperature, it is preferable to induce dissolution by adding a high-boiling solvent as a solubilizing agent. In a polycondensation reaction, the reaction is carried out while distilling off the solubilizing agent. In cases where a monomer having poor compatibility is present in a copolymerization reaction, it is preferable to first condense the monomer having a poor solubility with the acid or alcohol that is to be polycondensed with the monomer, then to effect polycondensation together with the main ingredient.

Illustrative examples of catalysts that may be used in preparing the crystalline polyester include titanium catalysts such as titanium tetraethoxide, titanium tetrapropoxide, titanium tetraisopropoxide and titanium tetrabutoxide; and tin catalysts such as dibutyltin dichloride, dibutyltin oxide and diphenyltin oxide.

From the standpoint of preparing the above block polymer, it is preferable for the crystalline polyester to be alcohol-terminated. To this end, in preparation of the crystalline polyester, it is preferable for the molar ratio of the acid ingredient to the alcohol ingredient (alcohol ingredient/carboxylic acid ingredient) to be at least 1.02 and not more than 1.20. The crystalline polyester has, in GPC measurement of the THF soluble matter, a number-average molecular weight (Mn) of preferably at least 2,000 and not more than 20,000, and a weight-average molecular weight (Mw) of preferably at least 4,000 and not more than 100,000. The Mn is more preferably in the range of at least 3,000 and not more than 15,000, and the Mw is more preferably in the range of at least 6,000 and not more than 80,000. The ratio Mw/Mn is preferably 6 or less, and more preferably 3 or less. The peak temperature (Tp) of the maximum endothermic peak measured by DSC is preferably at least 50° C. and not more than 85° C., and is more preferably at least 55° C. and not more than 80° C.

In the invention, preferred examples of the non-crystalline segments collectively made up of segments incapable of forming a crystalline structure (non-crystalline polymer chains) of the block polymer include polyester resins, polyurethane resins, polyurea resins, polyamide resins, polystyrene resins and styrene-acrylic polymers. A polyurethane obtained by reacting a diol with a diisocyanate is preferred.

The polyurethane serving as the non-crystalline segments is described. This polyurethane is a reaction product of a diol with a substance containing a diisocyanate group. Polyurethanes having various types of functionality can be obtained by adjusting the diol and the diisocyanate.

Examples of the diisocyanate include aromatic diisocyanates having at least 6 but not more than 20 carbons (excluding the carbon on the NCO group; the same applies below), aliphatic diisocyanates having at least 2 but not more than 18 carbons, alicyclic diisocyanates having at least 4 but not more than 15 carbons, modified forms of such diisocyanates (modified forms containing a urethane group, a carbodiimide group, an allophanate group, a urea group, a biuret group, a uretdione group, a uretimine group, an isocyanurate group or an oxazolidone group; these are also referred to below as "modified diisocyanates"), and mixtures of two or more thereof.

Examples of aliphatic diisocyanates include ethylene diisocyanate, tetramethylene diisocyanate, hexamethylene diisocyanate (HDI) and dodecamethylene diisocyanate.

Examples of alicyclic diisocyanates include isophorone diisocyanate (IPDI), dicyclohexylmethane 4,4'-diisocyanate, cyclohexylene diisocyanate and methylcyclohexylene diisocyanate.

Examples of aromatic diisocyanates include m- and/or p-xylylene diisocyanate (XDI) and α,α,α',α'-tetramethylxylylene diisocyanate.

Preferred examples of these include aromatic diisocyanates having at least 6 but not more than 15 carbons, aliphatic diisocyanates having at least 4 but not more than 12 carbons, and alicyclic diisocyanates having at least 4 but not more than 15 carbons. HDI, IPDI and XDI are especially preferred.

In addition to the above diisocyanates, isocyanate compounds having a functionality of 3 or more may also be used in the polyurethane resin.

Illustrative examples of diols that may be used in the urethane resin include alkylene glycols (ethylene glycol, 1,2-propylene glycol, 1,3-propylene glycol), alkylene ether glycols (polyethylene glycol, polypropylene glycol), alicyclic diols (1,4-cyclohexanedimethanol), bisphenols (bisphenol A), alkylene oxide (ethylene oxide, propylene oxide) adducts of the foregoing alicyclic diols, and polyester diols.

The alkyl moiety of the alkylene ether glycol may be linear or branched. In this invention, advantageous use can also be made of alkylene glycol having a branched structure.

The non-crystalline segments have a glass transition temperature of preferably at least 50° C. and not more than 130° C., and more preferably at least 70° C. and not more than 130° C. In this range, elasticity in the fixing region is easily maintained.

In the invention, the method used to prepare the block polymer may be a two-step method in which the segments capable of forming a crystalline structure and the segments incapable of forming a crystalline structure are separately prepared, following which the two are bonded together; or a one-step method in which the starting materials for the segments capable of forming a crystalline structure and the segments incapable of forming a crystalline structure are charged at the same time and prepared in a single operation. The block polymer used in the invention may be one selected by various methods while taking into account the reactivities of the respective terminal functional groups.

In cases where a binder is used, various types of binders may be used. A dehydration reaction or an addition reaction may be carried out using a polycarboxylic acid, a polyol, a polyisocyanate, a polyfunctional epoxy or a polyacid anhydride.

In the case of a block polymer wherein the segment capable of forming a crystalline structure is a polyester and the segment incapable of forming a crystalline structure is a polyurethane resin, the block polymer may be prepared by first preparing each of the different segments separately, then carrying out a urethane forming reaction between the alcohol ends of the crystalline polyester and the isocyanate ends of the polyurethane. Alternatively, synthesis may be carried out by mixing together a crystalline polyester having alcohol ends with the diol and the diisocyanate that are to make up the polyurethane, and heating the mixture. In this case, at the initial stage of the reaction in which the diol and diisocyanate concentrations are high, these selectively react to form the polyurethane. Once the molecular weight has become large to some degree, urethane formation arises between the isocyanate ends of the polyurethane and the alcohol ends of the crystalline polyester.

To fully achieve the effects of the above block polymer, it is preferable to avoid, to the extent possible, the presence of crystalline polyester homopolymers and non-crystalline polymer homopolymer within the toner. Specifically, it is preferable that the block polymerization ratio is high.

The block polymer preferably has a urethane bond concentration of at least 1.00 mmol/g but not more than 3.20 mmol/g.

By setting the urethane bond concentration to at least 1.00 mmol/g but not more than 3.20 mmol/g, even a block polymer containing numerous segments capable of forming a crystalline structure can maintain a higher level of viscosity at high temperatures, making it possible to maintain a good degree of gloss even in a high-temperature region. The urethane bond concentration is more preferably at least 1.40 mmol/g but not more than 2.60 mmol/g. In cases where urethane structures are introduced as the segments incapable of forming a crystalline structure, the urethane bond concentration of the block polymer can be controlled by adjusting the amount of diisocyanate added at this time.

The block polymer has a storage elastic modulus G' (Tp+25° C.) at a temperature 25° C. higher (Tp+25) (° C.) than the peak temperature Tp of the maximum endothermic peak from the binder resin, as measured by DSC, of preferably at least $1.0\times10^3$ Pa and not more than $1.0\times10^5$ Pa, and more preferably at least $2.0\times10^3$ Pa and not more than $7.0\times10^4$ Pa. By satisfying this condition, it is possible to further enhance the fixing performance and degree of gloss in high-temperature regions.

Moreover, the block polymer preferably contains at least 50 mass % but not more than 85 mass % of the segments capable of forming a crystalline structure. At a content within the block polymer of segments capable of forming a crystalline structure of at least 50 mass %, the sharp melt properties of the crystalline segments made up collectively of the individual segments capable of forming a crystalline structure are more readily and effectively manifested. A content of at least 60 mass % but not more than 85 mass % is even more preferred.

The content of segments incapable of forming a crystalline structure in the block polymer is preferably at least 10 mass %. At a content within the block polymer of segments incapable of forming a crystalline structure of at least 10 mass %, after sharp melting, the elasticity of the non-crystalline segments made up collectively of the individual segments incapable of forming a crystalline structure is well retained. The content is more preferably at least 15 mass %, even more preferably at least 15 mass % but less than 50 mass %, and still more preferably at least 15 mass % but not more than 40 mass %.

In GPC measurement of the THF soluble matter, the block polymer has a number-average molecular weight (Mn) of preferably at least 8,000 but not more than 30,000, and a weight-average molecular weight (Mw) of preferably at least 15,000 but not more than 60,000. Mn is more preferably in the range of at least 10,000 but not more than 25,000, and Mw is more preferably in the range of at least 25,000 but not more than 50,000. The ratio Mw/Mn is preferably 6 or less, and more preferably 3 or less. The peak temperature Tp of the maximum endothermic peak measured by DSC is preferably at least 50° C. but not more than 80° C., and more preferably at least 55° C. but not more than 70° C.

The binding resin in the invention may contain, in addition to the above block polymer, other resins which are known to be used as binding resins for toners. In such cases, the block polymer preferably contains the segments capable of forming a crystalline structure in a proportion of at least 50 mass % but not more than 85 mass %, relative to the total mass of the binding resin.

The wax used in the invention is an ester wax having ester bonds on the wax molecule. The ester wax used in the invention is an ester wax having a functionality of at least 3, preferably an ester wax having a functionality of at least 4, and more preferably an ester wax having a functionality of at least 6.

Ester waxes having a functionality of at least 3 are obtained by, for example, the condensation of an acid having a functionality of at least 3 with a long-chain linear saturated alcohol, or by synthesis involving the reaction of an alcohol having a functionality of at least 3 with a long-chain linear saturated fatty acid.

Examples of alcohols having a functionality of at least 3 that may be used include, but are not limited to, the following, which may also be used in admixture: glycerol, trimethylolpropane, erythritol, pentaerythritol and sorbitol; and condensation products thereof, such as polyglycerols (e.g., diglycerol, triglycerol, tetraglycerol, hexaglycerol, decaglycerol) obtained by the condensation of glycerol, ditrimethylolpropane and tristrimethylolpropane obtained by the condensation of trimethylolpropane, and dipentaerythritol and tripentaerythritol obtained by the condensation of pentaerythritol. Of these, alcohols having a branched structure are preferred, pentaerythritol or dipentaerythritol is more preferred, and dipentaerythritol is most preferred.

Long-chain linear saturated fatty acids preferred for use in the invention are ones of the general formula $C_nH_{2n+1}COOH$, wherein n is at least 5 but not more than 28.

Examples include, but are not limited to, the following, which may also be used in admixture: caproic acid, caprylic acid, octylic acid, nonylic acid, decanoic acid, dodecanoic acid, lauric acid, tridecanoic acid, myristic acid, palmitic acid, stearic acid, and behenic acid. Of these myristic acid, palmitic acid, stearic acid and behenic acid are preferred from the standpoint of the melting point of the wax.

Examples of acids having a functionality of at least 3 which may be used in the invention include, but are not limited to, the following, which may also be used in admixture: trimellitic acid and butanetetracarboxylic acid.

Long-chain linear saturated alcohols preferred for use in the invention are ones of the general formula $C_nH_{2n+1}OH$, wherein n is at least 5 but not more than 28.

Examples include, but are not limited to, the following, which may also be used in admixture: capryl alcohol, lauryl alcohol, myristyl alcohol, palmityl alcohol, stearyl alcohol and behenyl alcohol. Of these, myristyl alcohol, palmityl alcohol, stearyl alcohol and behenyl alcohol are preferred from the standpoint of the melting point of the wax.

In the invention, the maximum endothermic peak in DSC measurement of the wax has a peak temperature of preferably at least 65° C., more preferably at least 65° C. but not more than 85° C., and even more preferably at least 65° C. but not more than 80° C. By having the peak temperature of the maximum endothermic peak for the wax fall within the above range, the wax suitably melts during fixing yet retains a heat-resistant storage stability, thus enabling an even better low-temperature fixability and offset resistance to be obtained.

In the invention, the wax has a saponification value of preferably at least 160 mgKOH/g, and more preferably at least 160 mgKOH/g but not more than 230 mgKOH/g. At a saponification value of at least 160 mgKOH/g, the dispersibility of the wax in the toner is even better.

In the invention, the wax has a molecular weight of preferably at least 1,500 but not more than 2,200, and more preferably at least 1,600 but not more than 2,000. By having the molecular weight of the wax fall within this range, flowability following heat-resistant storage in a heat-cycling environment subjected to repeated temperature rises and temperature drops is easily maintained. Moreover, the wax bleeds out easily during fixing, making it possible to further improve the offset resistance at low temperatures.

In the invention, the wax content is preferably at least 2.0 parts by mass but not more than 8.0 parts by mass per 100 parts by mass of the binder resin. By having the wax content fall within the above range, wax bleedout does not readily occur during toner storage, enabling a good release effect to be obtained during fixing and thus further enhancing the offset resistance.

In the toner of the invention, a colorant is required in order to impart a tinting strength. Use may be made of colorants which have hitherto been used in toners, although colorants preferred for use in the inventive toner include the following organic pigments, organic dyes, inorganic pigments, and also, as black colorants, carbon blacks and magnetic powders.

Exemplary yellow colorants include condensed azo compounds, isoindolinone compounds, anthraquinone compounds, azo metal complexes, methine compounds and allylamide compounds. Preferred examples of yellow colorants that may be used include C.I. Pigment Yellow 12, 13, 14, 15, 17, 62, 74, 83, 93, 94, 95, 109, 110, 111, 128, 129, 147, 155, 168 and 180.

Exemplary magenta pigments include condensed azo compounds, diketopyrrolopyrrole compounds, anthraquinone and quinacridone compounds, basic dye lake compounds, naphthol compounds, benzimidazolone compounds, thioindigo compound and perylene compounds. Preferred examples of magenta pigments that may be used include C.I. Pigment Red 2, 3, 5, 6, 7, 23, 48:2, 48:3, 48:4, 57:1, 81:1, 122, 144, 146, 166, 169, 177, 184, 185, 202, 206, 220, 221 and 254.

Exemplary cyan pigments include copper phthalocyanine compounds and derivatives thereof, anthraquinone compounds, and basic dye lake compounds. Preferred examples of cyan pigments that may be used include C.I. Pigment Blue 1, 7, 15, 15:1, 15:2, 15:3, 15:4, 60, 62 and 66.

The colorants used in the toner of the invention are selected from the standpoint of hue angle, chroma, lightness, lightfastness, OHP transparency, and dispersibility in toner. These colorants are preferably used by addition in an amount of at least 1 part by mass but not more than 20 parts by mass per 100 parts by mass of the binder resin.

When carbon black is used as the black colorant, addition in an amount of at least 1 part by mass but not more than 20 parts by mass per 100 parts by mass of the binder resin is preferred. When magnetic powder is used as the black colorant, addition in an amount of at least 40 parts by mass but not more than 150 parts by mass per 100 parts by mass of the binder resin is preferred.

In the toner of the invention, a charge control agent may be optionally mixed and used with the toner particles. Alternatively, a charge control agent may be added at the time of toner particle production. Including a charge control agent stabilizes the charge properties, enabling optimal triboelectric charge quantity control for the development system.

Use may be made of a known charge control agent, with a charge control agent having a rapid charging speed and capable of stably maintaining a constant charge quantity being preferred.

Exemplary charge control agents for controlling the toner to a negative charge include organic metal compounds and chelate compounds, which are both effective, and also monoazo metal compounds, acetylacetone metal compounds, aromatic oxycarboxylic acids, aromatic dicarboxylic acids, and oxycarboxylic acid- or dicarboxylic acid-based metal compounds.

The toner of the invention may include such a charge control agent either alone or as a combination of two or more thereof.

The amount of the charge control agent included per 100 parts by mass of the binder resin is preferably at least 0.01 parts by mass but not more than 20 parts by mass, and more preferably at least 0.5 parts by mass but not more than 10 parts by mass.

One way of achieving the properties of the inventive toner is to produce the toner in an unheated state. Here, "to produce the toner in an unheated state" means to pass not even once through a temperature higher than the melting point of the crystalline resin, such as the crystalline polyester included in the toner or the resin having crystalline polyester segments. However, this does not apply to heating in the production of the crystalline resin.

When a crystalline polyester is heated at its melting point or higher, the crystallinity readily breaks down. Therefore, by carrying out toner production without such heating, no loss in the crystallinity of the crystalline polyester included within the toner occurs, making it possible to obtain a toner containing crystalline polyester which maintains its crystallinity.

In the present invention, an exemplary, non-limiting, method of producing toner without heating is the solution suspension method described below. Specifically, the toner particles that may be used in the inventive toner include, according to one embodiment, toner particles produced by the steps of: (i) preparing a dissolved material or dispersed material by dissolving or dispersing the binder resin, the colorant and the wax in an organic solvent; (ii) preparing a dispersion by dispersing the dissolved material or the dispersed material in a dispersion medium containing carbon dioxide in a supercritical state or a liquid state where resin fine particles have been dispersed; and (iii) forming toner particles by removing the organic solvent from the dispersion.

In the production of a toner containing the above-described crystalline polyester, carbon dioxide in a high-pressure state may be used in the above manner as the dispersion medium. In this method, granulation is carried out by dispersing a solution of the binder resin to be used in the toner within carbon dioxide under a high-pressure state, following which the organic solvent contained in the granulated particles is removed by extraction to a carbon dioxide phase and the pressure is subsequently released, thereby separating off the carbon dioxide and obtaining toner particles. The high-pressure carbon dioxide preferably used in the invention is liquid carbon dioxide or carbon dioxide in a supercritical state. The dispersion medium is preferably composed primarily (i.e., 50 mass % or more) of carbon dioxide in a high-pressure state.

Here, "liquid carbon dioxide" refers to carbon dioxide under temperature and pressure conditions within the area enclosed by the gas-liquid boundary line which passes through the triple point in the phase diagram for carbon dioxide (temperature=−57° C., pressure=0.5 MPa) and the critical point (temperature=31° C., pressure=7.4 MPa), the isotherm at the critical temperature and the solid-liquid boundary line. Also, "carbon dioxide in a supercritical state" refers to carbon dioxide under temperature and pressure conditions at or above the carbon dioxide critical point.

In the invention, an organic solvent may be included as another ingredient in the dispersion medium. In such a case, it is preferable for the carbon dioxide and the organic solvent to form a homogeneous phase.

In such a method, granulation is carried out under a high pressure. This is especially preferable because the crystallinity of the crystalline polyester is easily maintained and may even be further increased.

An example of a method for producing toner particles using carbon dioxide in a liquid or supercritical state as the dispersion medium which are highly suitable for obtaining the toner particles of the invention is described below.

First, a binder resin, a colorant, a wax and other optional additives are added to an organic solvent capable of dissolving the binder resin, and the system is uniformly dissolved or dispersed with a disperser such as a homogenizer, a ball mill, colloid mill, or an ultrasonic disperser.

The organic solvent used in the invention is preferably one which is capable of dissolving the binder resin. A ketone solvent such as acetone or methyl ethyl ketone is desirable. Of these, the use of acetone is most preferred.

It is preferable for the binder resin to have an acetone insoluble matter of 1.0 mass % or less. At an acetone insoluble matter in excess of 1.0 mass %, the viscosity at the time of toner production becomes high, as a result of which there is a tendency for the toner particle size to be large and for the particle size distribution to be broad. The acetone insoluble matter is more preferably 0.5 mass % or less.

Next, the dissolution or dispersion thus obtained (sometimes referred to below simply as the "binder resin solution") is dispersed in carbon dioxide in a liquid or supercritical state, thereby forming liquid drops.

It is preferable at this time to disperse a dispersant within the carbon dioxide in a liquid or supercritical state which serves as the dispersion medium. The dispersant may be an inorganic fine particle dispersant, an organic fine particle dispersant, or a mixture thereof, and may be used singly or as a combination of two or more thereof according to the intended purpose.

Examples of inorganic fine particle dispersants include inorganic fine particles of silica, alumina, zinc oxide, titania or calcium oxide.

Examples of organic fine particle dispersants include vinyl resins, urethane resins, epoxy resins, ester resins, polyamides, polyimides, silicone resins, fluororesins, phenolic resins, melamine resins, benzoguanamine resins, urea resins, aniline resins, ionomer resins, polycarbonates, celluloses, and mixtures thereof.

When organic resin fine particles composed of a non-crystalline resin are used as the dispersant, the carbon dioxide dissolves in the resin and solubilizes the resin, lowering its glass transition temperature, and thereby facilitating the agglomeration of particles during granulation. Accordingly, it is preferable to use a resin having crystallinity as the organic resin fine particles. In cases where a non-crystalline resin is used, it is preferable to introduce a crosslinked structure into the resin. Alternatively, fine particles obtained by coating non-crystalline resin particles with a crystalline resin may be used.

The dispersant may be used directly as is, or it may be used in a form that has been surface modified by various types of treatment in order to increase adsorptivity to the surface of the oil drops during granulation. Specific examples of such treatment include surface treatment with a silane, titanate or aluminate coupling agent, surface treatment with various types of surfactants, and coating treatment with a polymer.

Because the dispersant that has adsorbed to the surface of the oil drops remains in this form following toner particle formation, when resin fine particles are used as the dispersant, toner particles surface-coated with resin fine particles can be formed.

The particle size of the above resin fine particles, expressed as the volume average particle diameter, is preferably at least 30 nm but not more than 300 nm, and more preferably at least 50 nm but not more than 100 nm. By setting the particle size of the resin fine particles in this range, the stability of the oil drops during granulation can be further increased.

The amount of the resin fine particles included per 100 parts by mass of the solids content in the binder resin solution used to form the oil drops is preferably at least 3.0 parts by mass but not more than 15.0 parts by mass, and can be suitably adjusted according to the stability of the oil drops and the desired particle size.

In the invention, any suitable method may be used as the method for dispersing the above dispersant in carbon dioxide in a liquid or supercritical state. One exemplary method involves charging the dispersant and the carbon dioxide in a liquid or supercritical state into a vessel, and directly effecting dispersion by stirring or ultrasonic irradiation. Another method involves the use of a high-pressure pump to inject an organic solvent dispersion of the dispersant into a vessel that has been charged with carbon dioxide in a liquid or supercritical state.

Moreover, in this invention, any method may be used to disperse the binder resin solution in carbon dioxide in a liquid or supercritical state. One exemplary method involves the use of a high-pressure pump to inject the binder resin solution into a vessel containing carbon dioxide in a liquid or supercritical state within which the dispersant has been dispersed. Another method involves introducing carbon dioxide in a liquid or supercritical state within which the dispersant has been dispersed into a vessel that has been charged with the binder resin solution.

In the invention, the dispersion medium obtained using carbon dioxide in a liquid or supercritical state is preferably composed of a single phase. When granulation is carried out by dispersing the binder resin solution in carbon dioxide in a liquid or supercritical state, a portion of the organic solvent within the oil drops migrates into the dispersion medium. It is undesirable at this time for the carbon dioxide phase and the organic solvent phase to exist in a separated state because this causes a loss of oil drop stability. Therefore, the temperature and pressure of the dispersion medium and the amount of the binder resin solution with respect to the carbon dioxide in a liquid or supercritical state are preferably adjusted within ranges where the carbon dioxide and the organic solvent can be formed into a homogenous phase.

In setting the temperature and pressure of the dispersion medium, attention must also be paid to the granulating ability (ease of oil particle formation) and the solubility in the dispersion medium of the constituent ingredients within the binder resin solution. For example, depending on the temperature or pressure conditions, the binder resin and wax within the binder resin solution may dissolve in the dispersion medium. Generally, at lower temperature and pressure, the solubility of these ingredients in the dispersion medium is suppressed, but the oil drops that have formed readily condense and coalesce, lowering the granulating ability. On the other hand, at higher temperature and pressure, the granulating ability increases, but the above ingredients tend to readily dissolve in the dispersion medium.

In addition, the temperature of the dispersion medium must be lower than the melting point of the crystalline polyester in order to keep the crystallinity of the crystalline polyester component from being lost.

Therefore, in the production of the toner particles, it is preferable for the temperature of the dispersion medium to be in the temperature range of at least 10° C. but less than the melting point of the crystalline polyester.

Also, the pressure within the vessel where the dispersion medium is formed is preferably at least 1 MPa but not more than 20 MPa, and more preferably at least 2 MPa but not more than 15 MPa. In the invention, when a component other than carbon dioxide is included in the dispersion medium, "pressure" refers to the total pressure.

The proportion of carbon dioxide within the dispersion medium in the invention is preferably at least 70 mass %, more preferably at least 80 mass %, and even more preferably at least 90 mass %.

Following the completion of such granulation, the organic solvent remaining in the oil drops is removed by means of the dispersion medium containing carbon dioxide in a liquid or supercritical state. Specifically, such removal is carried out by mixing additional carbon dioxide in a liquid or supercritical state into the dispersion medium in which the oil drops have been dispersed, extracting the residual organic solvent into the carbon dioxide phase, and replacing the carbon dioxide containing this organic solvent with fresh carbon dioxide in a liquid or supercritical state.

Mixture of the dispersion medium and the carbon dioxide in a liquid or supercritical state may be carried out by adding carbon dioxide in a higher-pressure liquid or supercritical state to the dispersion medium, or by adding the dispersion medium to carbon dioxide in a lower-pressure liquid or supercritical state.

The method of replacing the organic solvent-containing carbon dioxide with carbon dioxide in a liquid or supercritical state is exemplified by a method in which carbon dioxide in a liquid or supercritical state is passed through the vessel while holding the interior of the vessel at a constant pressure. This is carried out while using a filter to collect the toner particles that form.

In a state where substitution with carbon dioxide in a liquid or supercritical state is inadequate or organic solvent remains within the dispersion medium, there are times where, when the pressure of the vessel is reduced in order to recover the toner particles that have formed, the organic solvent dissolved within the dispersion medium condenses, leading to undesirable effects such as re-dissolution of the toner particles or coalescence of the toner particles. Therefore, substitution with carbon dioxide in a liquid or supercritical state must be carried out until the organic solvent has been completely removed. The amount of carbon dioxide in a liquid or supercritical state which is passed through is preferably at least one time but not more than 100 times, more preferably at least one time and not more than 50 times, and most preferably at least one time but not more than 30 times, with respect to the volume of the dispersion medium.

When reducing the pressure of the vessel and removing the toner particles from the dispersion medium containing carbon dioxide in a liquid or supercritical state, the temperature and pressure may be lowered in a single operation to normal temperature and pressure, or the pressure may be reduced in a stepwise manner by providing vessels in a plurality of stages, each of the vessels being independently pressure-controlled. The rate of pressure reduction is preferably set within a range where foaming of the toner particles does not occur.

The organic solvent used in the invention and the carbon dioxide in a liquid or supercritical state may be recycled.

In addition, the toner of the invention preferably passes through a step in which it is heat-treated under lower temperature conditions than the melting point of the crystalline polyester. In the invention, such heat treatment is referred to below as annealing treatment. It is generally known that when a crystalline resin is subjected to annealing treatment, the crystallinity rises. The reason is thought to be as follows. When annealing treatment is carried out on a crystalline material, because the molecular mobility of the polymer chains increases to some degree due to the heat, the polymer chains rearrange into a more stable structure, i.e., a regular crystalline structure; hence, crystallization occurs. In cases where treatment is carried out at a temperature equal to or higher than the melting point of the crystalline material, because the polymer chains acquire a higher energy than the energy required for reorientation, recrystallization does not occur.

Therefore, in order to maximize molecular movement of the crystalline polyester in the toner, it is important for annealing treatment in the invention to be carried out within a limited temperature range with respect to the melting point of the crystalline polyester.

In the invention, by carrying out the DSC measurement of toner particles obtained beforehand and determining the peak temperature of the endothermic peak from the crystalline polyester, it is possible to then determine the temperature of annealing treatment in accordance with this peak temperature. Specifically, it is preferable to carry out heat treatment at a temperature at least 15° C. below but not less than 5° C. below the peak temperature determined by DSC measurement at a ramp-up rate of 10.0° C./min. A temperature in the range of at least 10° C. below but not less than 5° C. below the peak temperature is more preferred.

In the invention, annealing treatment may be carried out at any stage after the toner particle forming step.

The annealing time may be suitably adjusted according to the proportion, type and crystal state of the crystalline polyester within the toner, although in general such treatment is carried out for preferably at least 1 hour but not more than 50 hours, and more preferably at least 2 hours but not more than 24 hours.

In cases where a wax-containing toner is used, the annealing rate may change due to compatible mixing with the crystalline polyester. When little compatible mixing occurs between the crystalline polyester and the wax, the crystallization rate of the crystalline polyester tends to speed up. Hence, the use of a wax that minimizes compatible mixing is effective from the standpoint of production.

It is desirable to add an inorganic fine powder as a flowability enhancer to the toner particles used in the invention. That is, it is preferable for the toner of the invention to include toner particles and an inorganic fine powder as an external additive. The inorganic fine powder is exemplified by fine powders such as silica fine powders, titanium oxide fine powders, alumina fine powders, and complex oxide fine powders thereof. Of these inorganic fine powders, silica fine powders and titanium oxide fine powders are preferred.

Examples of silica fine powders include dry silica or fumed silica produced by the vapor phase oxidation of silicon halides, and wet silica produced from water glass. Dry silica having few silanol groups or little $Na_2O$ and $SO_3^{2-}$ on the surface and at the interior of the silica fine powder is preferred as the inorganic fine powder. Alternatively, the dry silica may be a composite fine powder of silica and some other metal oxide which is produced by using in the production step a metal halide compound such as aluminum chloride or titanium chloride together with the silicon halide compound. Adding the inorganic fine powder externally to the toner particles is preferred for improving toner flowability and for achieving a uniform charging performance. By subjecting the inorganic fine powder to hydrophobic treatment, it is possible to adjust the charge quantity of the toner, enhance the environmental stability of the toner, and improve the properties of the toner in a high-humidity environment. Hence, the use of inorganic fine powder that has been hydrophobic treated is more preferred.

The treatment agent for hydrophobic treatment of the inorganic fine powder is exemplified by unmodified silicone waxes, various types of modified silicone waxes, unmodified silicone oils, various types of modified silicone oils, silane compounds, silane coupling agents, and other organosilicon compounds, as well as organotitanium compounds. These treatment agents may be used singly or in combination.

Of these, an inorganic fine powder treated with a silicone oil is preferred. A hydrophobic treated inorganic fine powder obtained by the hydrophobic treatment of an inorganic fine powder with a coupling agent and accompanied or followed by silicone oil treatment is more preferred because the charge quantity of the toner can be maintained at a high level even in a high-humidity atmosphere, which is good for reducing selective development.

The amount of the above inorganic fine powder added per 100 parts by mass of the toner particles is preferably at least 0.1 parts by mass but not more than 4.0 parts by mass, and more preferably at least 0.2 parts by mass but not more than 3.5 parts by mass.

The toner of the invention has a weight-average particle diameter (D4) of preferably at least 3.0 μm but not more than 8.0 μm, and more preferably at least 5.0 μm but not more than 7.0 μm. The use of a toner having such a weight-average particle diameter (D4) provides good handleability and also is desirable for fully satisfying dot reproducibility.

In addition, the toner of the invention has a ratio D4/D1 of the weight-average particle diameter (D4) to the number-average particle diameter (D1) of preferably 1.25 or less, and more preferably 1.20 or less.

Methods for measuring the various physical properties of the inventive toner are described below.

<Methods for Determining Peak Temperature (Tp) and Endothermic Quantity (ΔH) of Highest Endothermic Peak in DSC Measurement of Toner>

The peak temperature (Tp) of the maximum endothermic peak of the toner and the like (including the toner, crystalline polyester and block polymer) in the invention is measured under the following conditions using a Q1000 differential scanning calorimeter (manufactured by TA Instruments).

Ramp-up rate: 10° C./min

Measurement start temperature: 20° C.

Measurement end temperature: 180° C.

Temperature calibration for the apparatus detector is carried out using the melting points of indium and zinc. Heat quantity calibration is carried out using the heat of fusion for indium.

A specimen of about 5 mg is precisely weighed, then placed in a silver pan and a single measurement is carried out. The empty silver pan is used as the reference.

In cases where, when the toner is used as the specimen, the maximum endothermic peak (maximum endothermic peak from the binder resin) does not overlap with the endothermic peaks for the wax and resins other than the binder resin (for example, the shell phase resin in a toner having a core-shell structure), the endothermic quantity for the maximum endothermic peak as obtained is treated directly as the endothermic quantity for the maximum endothermic peak from the binder resin. On the other hand, in cases where, when the toner is used as the specimen, endothermic peaks for the wax and resins other than the binder resin overlap with the maximum endothermic peak for the binder resin, the endothermic quantities from the wax and resins other than the binder resin must be subtracted from the endothermic quantity for the maximum endothermic peak as obtained.

Using the method described below, the endothermic quantities from the wax and resins other than binder resins are subtracted from the endothermic quantity for the maximum endothermic peak as obtained, thereby giving the endothermic quantity for the maximum endothermic peak from the binder resin.

First, DSC measurement for the wax alone is separately carried out, and the endothermic properties are determined. Next, the wax content in the toner is determined. Measurement of the wax content in the toner, although not subject to any particular limitation, may be carried out by, for example, peak separation in DSC measurement or by known structural analysis. Next, the endothermic quantity from the wax is calculated from the wax content within the toner, and this portion is subtracted from the endothermic quantity for the maximum endothermic peak obtained above. In cases where the wax is readily compatible with the binder resin, the above wax content is multiplied by the compatibility ratio to calculate the endothermic quantity originating from the wax, which quantity must then be subtracted. The compatibility ratio is calculated from the value obtained by dividing the endothermic quantity determined for a 100:6 mixture of binder resin and wax (mass of binder resin:mass of wax) by a theoretical endothermic quantity calculated from the endothermic quantities for the binder resin and for wax alone which have been determined beforehand.

Endothermic quantities from resins other than the binder resin are determined by the same method as for wax. Here, the compatibility ratio is calculated from the value obtained by dividing the endothermic quantity determined for a 100:6 mixture of binder resin and a resin other than the binder resin (mass of binder resin:mass of resin other than the binder resin) by a theoretical endothermic quantity calculated from the endothermic quantities for the binder resin and for the resin other than the binder resin which have been determined beforehand.

In measurement, to arrive at the endothermic quantity per gram of the binder resin, the mass of components other than the binder resin must be excluded from the mass of the sample.

The content of ingredients other than the binder resin can be measured by a known analytic means. In cases where analysis is difficult, the incineration ash content of the toner is determined, and the amount obtained by adding to this the amount of ingredients (e.g., wax) other than the binder resin which are incinerated is treated as the content of ingredients other than the binder resin, and can be determined by subtraction from the mass of the toner.

The incineration ash content in the toner is determined as follows. About 2 g of toner is placed in a 30 mL porcelain crucible that has been pre-weighed. The crucible is placed in an electric furnace, heated at about 900° C. for about 3 hours, then allowed to cool within the furnace, and subsequently allowed to cool for at least 1 hour at normal temperature in a desiccator. The mass of the crucible containing the incineration ash content is then weighed, and the mass of the crucible is subtracted from this mass, thereby giving the incineration ash content.

In cases where multiple peaks are present, the "maximum endothermic peak" refers to the peak having the largest endothermic quantity. The endothermic quantity (ΔH) of the maximum endothermic peak is calculated from the area of the peak using analytical software furnished with the apparatus.

<Method for Determining Peak Temperature (Wax Melting Point) of Highest Endothermic Peak in DSC Measurement of Wax>

The peak temperature (wax melting point) of the maximum endothermic peak in the DSC measurement of wax is measured using a Q1000 differential scanning calorimeter (TA Instruments), in general accordance with ASTM D3418-82.

Temperature calibration for the apparatus detector is carried out using the melting points of indium and zinc. Heat quantity calibration is carried out using the heat of fusion for indium.

A specimen of about 2 mg is precisely weighed, then placed in an aluminum pan. Using the empty aluminum pan as the reference, temperature is carried out at a rate of temperature rise of 10° C./min within the measurement temperature range of 30 to 180° C. In measurement, the temperature is raised once to 180° C., then lowered to 30° C., following which the temperature is raised once again. The temperature indicating the maximum endothermic peak on the DSC curve in the course of this second temperature rise is treated as the melting point of wax. Here, in cases where multiple peaks are present, the maximum endothermic peak refers to the peak having the largest endothermic quantity.

<Method of Measuring Glass Transition Temperature (Tg) of Non-Crystalline Resin>

Tg measurement is carried out under the following conditions using a Q1000 differential scanning calorimeter (TA Instruments).

Measurement Conditions:

Modulation Mode

Ramp-up rate: 0.5° C./min

Modulation temperature amplitude: ±1.0° C./min

Measurement start temperature: 25° C.

Measurement end temperature: 130° C.

When the ramp-up rate is changed, a new measurement sample is furnished. Temperature rise is carried out once only, a DSC curve is plotted with "Reversing heat flow" on the vertical axis, and the onset value is treated as the glass transition point (Tg).

<Methods of Measuring Weight-Average Particle Diameter (D4) and Number-Average Particle Diameter (D1)>

The weight-average particle diameter (D4) and number-average particle diameter (D1) of the toner are calculated as follows. The measurement apparatus is a precision analyzer for particle characterization based on the pore electrical resistance method and equipped with a 100 μm aperture tube (Coulter Counter Multisizer [registered trademark], manufactured by Beckman Coulter). Dedicated software (Beckman Coulter Multisizer 3, Version 3.51 (from Beckman Coulter)) furnished with the device is used for setting the measurement conditions and analyzing the measurement data. Measurement is carried out with the following number of effective measurement channels: 25,000.

The aqueous electrolyte solution used in measurement is a solution obtained by dissolving sodium chloride (guaranteed reagent) in ion-exchanged water to a concentration of about 1 mass %, such as "ISOTON II" (Beckman Coulter).

Prior to carrying out measurement and analysis, the following settings are carried out in the software.

From the "Changing Standard Operating Mode (SOM)" screen of the software, select the Control Mode tab and set the Total Count to 50,000 particles, the Number of Runs to 1, and the Kd value to the value obtained using "Standard particle 10.0 μm" (Beckman Coulter). Pressing the "Threshold/Noise Level Measuring Button" automatically sets the threshold and noise levels. Set the Current to 1,600 μA, the Gain to 2, and the Electrolyte to ISOTON II, and place a check mark by "Flush aperture tube following measurement."

In the "Convert Pulses to Size" screen of the software, set the Bin Spacing to "Log Diameter," the Size Bins to 256, and the particle diameter range to from 2 μm to 60 μm.

The measurement method is as follows.

(1) About 200 mL of the above aqueous electrolyte solution is placed in a 250 mL glass round-bottomed beaker for the Multisizer 3, the beaker is set on the sample stand, and stirring is carried out counterclockwise with a stirrer rod at a speed of 24 rotations per second. The "Aperture Flush" function in the software is then used to remove debris and air bubbles from the aperture tube.

(2) About 30 mL of the aqueous electrolyte solution is placed in a 100 mL glass flat-bottomed beaker. About 0.3 mL of a dilution obtained by diluting the dispersant "Contaminon N" (a 10 mass % aqueous solution of a neutral (pH 7) cleanser for cleaning precision analyzers composed of a nonionic surfactant, a anionic surfactant and an organic builder; available from Wako Pure Chemical Industries, Ltd.) about 3-fold by mass with ion-exchanged water is added to the electrolyte solution.

(3) A Tetora 150 ultrasonic dispersion system (Nikkaki Bios) having an electrical output of 120 W and equipped with two oscillators which oscillate at 50 kHz and are configured at a phase offset of 180 degrees is prepared for use. About 3.3 L of ion-exchanged water is placed in the water tank of the system, and about 2 mL of Contaminon N is added to the tank.

(4) The beaker prepared in (2) above is set in a beaker-securing hole of the ultrasonic dispersion system, and the system is operated. The beaker height position is adjusted so as to maximize the resonance state of the aqueous electrolyte solution liquid level within the beaker.

(5) The aqueous electrolyte solution within the beaker in (4) above is subjected to ultrasonic irradiation while about 10 mg of toner is added a little at a time to the solution. Ultrasonic dispersion treatment is then continued for 60 seconds suitably regulating operation so that the water temperature in the tank is at least 10° C. but not more than 40° C.

(6) The dispersed toner-containing aqueous electrolyte solution in (5) is added dropwise with a pipette to the round-bottomed beaker in (1) above that has been set in the sample stand, and the measurement concentration is adjusted to about 5%. Measurement is then continued until the number of measured particles reaches 50,000.

(7) Analysis of the measurement data is carried out using the dedicated software provided with the Multisizer 3 system, and the weight-average particle diameter (D4) and the number-average particle diameter (D1) are computed. When "Graph/Vol %" is selected in the software program, the "average size" in the "Analysis/Volume Statistics (Arithmetic Average)" pane is the weight-average particle diameter (D4). When "Graph/No %" is selected, the "average size" in the "Analysis/Number Statistics (Arithmetic Average)" pane is the number-average particle diameter (D1).

<Methods of Measuring Molecular Weight Distribution, Number-Average Molecular Weight (Mn) and Weight-Average Molecular Weight (Mw) of Resin by Gel Permeation Chromatography>

The molecular weight distribution, number-average molecular weight (Mn) and weight-average molecular weight (Mw) of the resin (including the block polymer) are measured based on the tetrahydrofuran (THF) soluble matter by gel permeation chromatography (GPC) using THF as the solvent. The measurement conditions are as follows.

(1) Preparation of Measurement Sample:

Resin (as the sample) and THF are mixed to a concentration of 5 mg/mL and left at room temperature for 5 to 6 hours, following which they are thoroughly shaken, and the THF and sample are mixed well until the coalesce of the sample was fully dispersed. The dispersion is left at rest for at least 12 hours at room temperature. The length of time from the moment that mixing of the sample and THF begins until the moment that standing of the mixture ends is set to at least 24 hours.

The mixture is then passed through a sample treatment filter (pore size, 0.45 to 0.5 μm; MyShoriDisk H-25-2 (Tosoh Corporation)), and the filtered mixture is used as the GPC sample.

(2) Sample Measurement:

The column is stabilized in a 40° C. heat chamber and, while passing THF as the solvent at a flow rate of 1 mL per minute through the column at this temperature, 200 μL of a THF sample solution of the resin adjusted to a sample concentration of 5 mg/mL is poured in and measured.

The molecular weight of the sample was measured by calculating the molecular weight distribution of the sample from the relationship between the logarithmic values and counts on a calibration curve prepared using several types of monodispersed polystyrene standard samples.

The standard polystyrene samples used for calibration curve preparation are samples having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$ produced by Pressure Chemical Co. or Toyo Soda Kogyo. The detector used is a refractive index (R1) detector.

As for the columns, in order to carry out suitable measurement in a molecular weight range from $1\times10^3$ to $2\times10^6$, a plurality of commercial polystyrene gel columns are used in combination as indicated below. In the invention, the GPC measurement conditions are as follows.

GPC Measurement Conditions:

Apparatus: LC-GPC 150C (Waters Associates, Inc.)

Columns: A series of the seven columns KF801, 802, 803, 804, 805, 806, 807 (Shodex)

Column temperature: 40° C.

Mobile phase: (THF) tetrahydrofuran

<Method of Measuring Proportion of Segments Capable of Adopting a Crystal Structure>

The proportion (mass %) of segments capable of forming a crystalline structure in the block polymer is measured by $^1$H-NMR under the following conditions.

Measurement apparatus: FT NMR spectrometer JNM-EX400 (JEOL Ltd.)

Measurement frequency: 400 MHz

Pulse conditions: 5.0 μs

Frequency range: 10,500 Hz

Number of runs: 64

Measurement temperature: 30° C.

The sample is prepared by placing 50 mg of block polymer in a sample tube having an inside diameter of 5 mm, adding heavy chloroform ($CDCl_3$) as the solvent, and dissolving in a 40° C. thermostatic tank. On the resulting $^1$H-NMR chart, of the peaks assigned to constituent features of the segments capable of forming a crystalline structure, a peak that is independent of peaks assigned to the other features is selected, and the integrated value $S_1$ for that peak is computed. Similarly, of the peaks assigned to constituent features of the non-crystalline segments, a peak that is independent of peaks assigned to the other features is selected, and the integrated value $S_2$ for that peak is computed. The proportion of segments capable of forming a crystalline structure is determined as follows using the above integrated values $S_1$ and $S_2$. In addition, $n_1$ and $n_2$ are the number of hydrogens in the constituent features to which peaks have been assigned.

$$\text{Proportion(mol \%) of segments capable of forming a crystalline structure}=\{(S_1/n_1)/((S_1/n_1)+(S_2/n_2))\}\times 100$$

The proportion (mol %) of segments capable of forming a crystalline structure is converted to mass % using the molecular weights of the respective ingredients.

<Measurement of Wax Saponification Value>

The basic operations are carried out according to JIS K-0070.

(1) A sample of from 1 to 3 g is weighed out, and the weight is referred to as W (g).

(2) The sample is placed in a 300 mL Erlenmeyer flask, then 25 mL of a 0.5 mol/L solution of KOH in ethanol is added.

(3) An air condenser is attached to the Erlenmeyer flask, and the contents are reacted under 30 minutes of gentle heating in a water bath, sand bath or on a hot plate while occasionally stirring the contents. During heating, the heating temperature is adjusted so that the ring of refluxing ethanol does not reach the top edge of the air condenser.

(4) Following reaction completion, the contents are immediately cooled. Before the contents have time to harden into a gel, the inside walls are washed by spraying from above the air condenser with a small amount of water or a xylene/ethanol (1/3) mixture, following which the air condenser is removed.

(5) Using 0.5 mol/L hydrochloric acid, titration is carried out with a potentiometric titrator (for example, automated titration carried out with the AT-400 potentiometric titrator (Win Workstation) and the ABP-410 automatic burette available from Kyoto Electronics Manufacturing may be used).

(6) The amount of hydrochloric acid used at this time is set to S (mL). A blank is measured at the same time, the amount of hydrochloric acid used for the blank being set to B (mL).

(7) The saponification value is calculated from the following formula, wherein f is a hydrochloric acid factor.

$$\text{Saponification value(mgKOH/g)}=\{(B-S)\times f\times 28.05\}/W$$

<Method of Measuring Volume-Average Particle Diameter of Resin Fine Particles in Resin Fine Particle Dispersion and Volume-Average Particle Diameter of Wax Particles in Wax Dispersion>

The volume-average particle diameters (μm or nm) of the resin fine particles in the resin fine particle dispersion and of wax particles in the wax dispersion are measured using a Microtrac Particle Size/Distribution Analyzer HRA (X-100, from Nikkiso) at a particle diameter range setting of from 0.001 μm to 10 μm.

<Method of Measuring Urethane Bond Concentration of Resin>

The urethane bond concentration of the resin is measured by $^1$H-NMR spectroscopy.

$^1$H-NMR measurement is carried out under the following conditions.

Measurement apparatus: FT NMR spectrometer JNM-EX400 (JEOL Ltd.)

Measurement frequency: 400 MHz

Pulse conditions: 5.0 μs

Frequency range: 10,500 Hz

Number of runs: 64

Measurement temperature: 30° C.

The sample is prepared by placing 50 mg of the specimen to be measured in a sample tube having an inside diameter of 5 mm, adding $CDCl_3$ as the solvent, and dissolving in a thermostatic tank at 40° C.

The hydrogen ratios of the constituent units in the resin used are determined by means of the resulting $^1$H-NMR chart, based on which the molar ratio for the composition is determined.

The concentration of constituent units making up the urethane bonds per gram is determined from the molar ratios thus determined and the molecular weights, and this result is treated as the urethane bond concentration (mmol/g).

<Method of Measuring Storage Elastic Modulus G' of Block Polymer>

The storage elastic modulus G' of the block polymer is measured using an ARES rheometer (Rheometrics Scientific) . The method of measurement, which is briefly described in the ARES operating manuals 902-30004 (August 1997 edition) and 902-00153 (July 1993 edition) published by Rheometrics Scientific, is as follows.

Measurement jig: torsion rectangular

Measurement sample: The block polymer is fabricated with a pressure molding machine (by maintaining a pressure of 15 kN for 1 minute at normal temperature) into a rectangular solid sample having a width of about 12 mm, a height of about 20 mm and a thickness of about 2.5 mm. The pressure molding machine used is a 100 kN press NT-100H (from NPa System).

Figure 4:
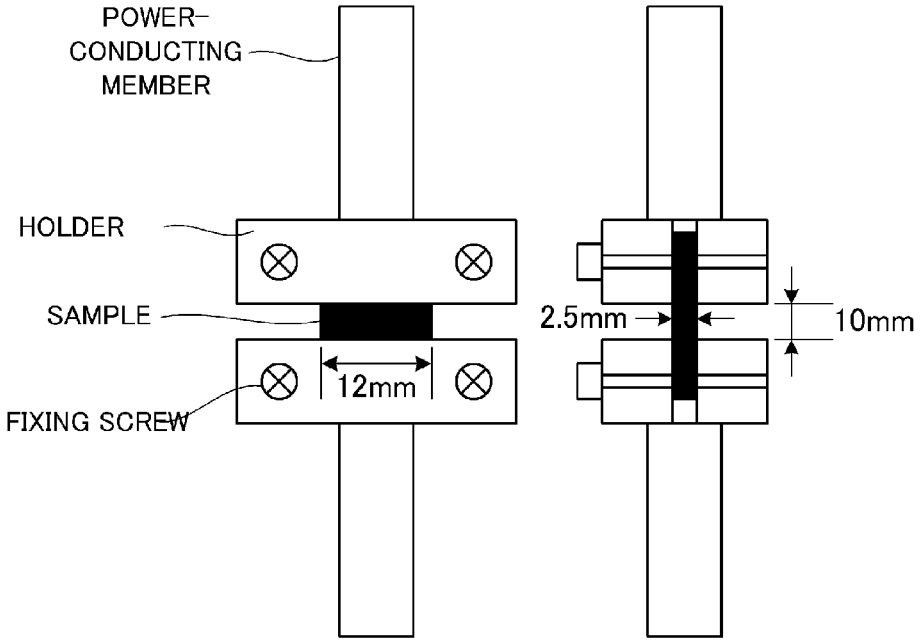
FIG. 4 is schematic diagram showing a rheometer.

The jig and the sample are left to stand at normal temperature (23° C.) for 1 hour, following which the sample is mounted in the jig (see FIG. 4). As shown in FIG. 4, the sample is fixed in such a way as to set the dimensions of the measurement area to a width of about 12 mm, a thickness of about 2.5 mm, and a height of 10 mm. The temperature is adjusted over 10 minutes to a measurement starting temperature of 30.00° C., after which measurement is carried out under the following settings.

Measurement frequency: 6.28 radian/s

Measurement strain setting: Initial value is set to 0.1%, and measurement is carried out in automated measurement mode Sample elongation correction: Adjusted in automated measurement mode Measurement temperature: Temperature is increase from 30° C. to 150° C. at a rate of 2° C./min Measurement interval: Viscoelastic data is measured at 30-second intervals; that is, at 1° C. intervals Data is transferred via an interface to an RSI Orchestrator (control, data collection and analysis software (Rheometrics Scientific)) operating on Windows 2000 (registered trademark) (Microsoft Corporation).

The storage elastic modulus (G'(Tp+25)) value for the block polymer at a temperature 25° C. higher than the peak temperature Tp for the maximum endothermic peak from the binder resin, as determined by the above-described DSC measurement of the toner, is read off from this data.

EXAMPLES

The invention is described in greater detail below by way of examples, although the invention is not limited by these examples. Unless noted otherwise, all parts and percent (%) mentioned in the examples and the comparative examples are by mass.

<Synthesis of Crystalline Polyester 1>

The following starting materials were charged into a heat-dried two-necked flask while introducing nitrogen.

| | |
|---|---|
| Sebacic acid | 136.2 parts by mass |
| 1,4-Butanediol | 63.8 parts by mass |
| Dibutyltin oxide | 0.1 parts by mass |

The interior of the system was flushed with nitrogen drawn in under vacuum operation, following which the contents were stirred at 180° C. for 6 hours. Next, while stirring was continued, the temperature was gradually raised to 230° C. under reduced pressure, and held in that state for another 2 hours. When the contents had acquired a viscous state, the system was air-cooled, thereby stopping the reaction and yielding Crystalline Polyester 1. The physical properties of Crystalline Polyester 1 are shown in Table 1.

<Synthesis of Crystalline Polyester 2>

Aside from changing the starting materials charged into the flask to those listed below, Crystalline Polyester 2 was synthesized in exactly the same way as Crystalline Polyester 1. The physical properties of Crystalline Polyester 2 are shown in Table 1.

| | |
|---|---|
| Sebacic acid | 75.9 parts by mass |
| Adipic acid | 53.9 parts by mass |
| 1,4-Butanediol | 70.2 parts by mass |
| Dibutyltin oxide | 0.1 parts by mass |

<Synthesis of Crystalline Polyester 3>

Aside from changing the starting materials charged into the flask to those listed below, Crystalline Polyester 3 was synthesized in exactly the same way as Crystalline Polyester 1. The physical properties of Crystalline Polyester 3 are shown in Table 1.

| | |
|---|---|
| Dodecanedioic acid | 116.5 parts by mass |
| 1,10-Decanediol | 83.5 parts by mass |
| Dibutyltin oxide | 0.1 parts by mass |

<Synthesis of Crystalline Polyester 4>

Aside from changing the starting materials charged into the flask to those listed below, Crystalline Polyester 4 was synthesized in exactly the same way as Crystalline Polyester 1. The physical properties of Crystalline Polyester 4 are shown in Table 1.

| | |
|---|---|
| Sebacic acid | 105.0 parts by mass |
| Adipic acid | 28.0 parts by mass |
| 1,4-Butanediol | 67.0 parts by mass |
| Dibutyltin oxide | 0.1 parts by mass |

<Synthesis of Crystalline Polyester 5>

Aside from changing the starting materials charged into the flask to those listed below, Crystalline Polyester 5 was synthesized in exactly the same way as Crystalline Polyester 1. The physical properties of Crystalline Polyester 5 are shown in Table 1.

| | |
|---|---|
| Octadecanedioic acid | 152.9 parts by mass |
| 1,4-Butanediol | 47.1 parts by mass |
| Dibutyltin oxide | 0.1 parts by mass |

<Synthesis of Crystalline Polyester 6>

Aside from changing the starting materials charged into the flask to those listed below, Crystalline Polyester 6 was synthesized in exactly the same way as Crystalline Polyester 1. The physical properties of Crystalline Polyester 6 are shown in Table 1.

| | |
|---|---|
| Sebacic acid | 111.7 parts by mass |
| Adipic acid | 21.9 parts by mass |
| 1,4-Butanediol | 66.4 parts by mass |
| Dibutyltin oxide | 0.1 parts by mass |

<Synthesis of Crystalline Polyester 7>

Aside from changing the starting materials charged into the flask to those listed below, Crystalline Polyester 7 was synthesized in exactly the same way as Crystalline Polyester 1. The physical properties of Crystalline Polyester 7 are shown in Table 1.

| | |
|---|---|
| Tetradecanedioic acid | 134.0 parts by mass |
| 1,6-Hexanediol | 66.0 parts by mass |
| Dibutyltin oxide | 0.1 parts by mass |

<Synthesis of Crystalline Polyester 8>

Aside from changing the starting materials charged into the flask to those listed below, Crystalline Polyester 8 was synthesized in exactly the same way as Crystalline Polyester 1. The physical properties of Crystalline Polyester 8 are shown in Table 1.

| | |
|---|---|
| Sebacic acid | 137.5 parts by mass |
| 1,4-Butanediol | 62.5 parts by mass |
| Dibutyltin oxide | 0.1 parts by mass |

<Synthesis of Block Polymer 1>

| | |
|---|---|
| Crystalline Polyester 1 | 210.0 parts by mass |
| Xylylene diisocyanate (XDI) | 56.0 parts by mass |
| Cyclohexane dimethanol (CHDM) | 34.0 parts by mass |
| Tetrahydrofuran (THF) | 300.0 parts by mass |

A reactor vessel equipped with a stirrer and a thermometer was charged, under nitrogen flushing, with the above ingredients. The contents were heated at 50° C. and a urethane-forming reaction was carried out over a period of 15 hours. Next, 3.0 parts by mass of t-butyl alcohol was added, and the isocyanate ends were modified. The THF serving as the solvent was distilled off, giving Block Polymer 1. The physical properties of the block polymer are shown in Table 2.

<Synthesis of Block Polymers 2 to 12>

Aside from changing the materials and amounts as shown in Table 2, Block Polymers 2 to 12 were obtained in the same way as in the synthesis of Block Polymer 1. The physical properties of Block Polymers 2 to 12 are shown in Table 2.

<Preparation of Block Polymer Resin Solutions 1 to 12>

A beaker equipped with a stirrer was charged with 100.0 parts by mass of acetone and 100.0 parts by mass of block polymer 1, following which stirring was continued at a temperature of 40° C. until dissolution was complete, thereby preparing Block Polymer Resin Solution 1. Block Polymer Resin Solutions 2 to 12 were prepared in the same way.

<Synthesis of Non-Crystalline Resin 1>

| | |
|---|---|
| Xylylene diisocyanate (XDI) | 117.0 parts by mass |
| Cyclohexane dimethanol (CHDM) | 83.0 parts by mass |
| Acetone | 200.0 parts by mass |

A reactor vessel equipped with a stirrer and a thermometer was charged, under nitrogen flushing, with the above ingredients. The contents were heated at 50° C. and a urethane-forming reaction was carried out over a period of 15 hours. Next, 3.0 parts by mass of t-butyl alcohol was added, and the isocyanate ends were modified. The acetone serving as the solvent was distilled off, giving Non-Crystalline Resin 1. The Non-Crystalline Resin 1 thus obtained had a Mn of 4,400 and a Mw of 20,000.

<Preparation of Crystalline Polyester Resin Dispersion 1>

| | |
|---|---|
| Crystalline Polyester 8 | 115.0 parts by mass |
| Ionic surfactant Neogen RK (Dai-Ichi Kogyo Seiyaku) | 5.0 parts by mass |
| Ion-exchanged water | 180.0 parts by mass |

The above ingredients were mixed and heated to 100° C., thoroughly dispersed with an Ultra-Turrax T50 disperser (IKA), then subjected to 1 hour of dispersion treatment in a pressure discharge-type Gaulin homogenizer, giving Crystalline Polyester Resin Dispersion 1 having a volume-average particle diameter of 180 nm and a solids content of 38.3 mass %.

<Preparation of Non-Crystalline Resin Dispersion 1>

| | |
|---|---|
| Non-Crystalline Resin 1 | 115.0 parts by mass |
| Ionic surfactant Neogen RK (Dai-Ichi Kogyo Seiyaku) | 5.0 parts by mass |
| Ion-exchanged water | 180.0 parts by mass |

The above ingredients were mixed and heated to 100° C., thoroughly dispersed with an Ultra-Turrax T50 disperser (IKA), then subjected to 1 hour of dispersion treatment in a pressure discharge-type Gaulin homogenizer, giving Non-Crystalline Resin Dispersion 1 having a volume-average particle diameter of 200 nm and a solids content of 38.3 mass %.

<Preparation of Resin Fine Particle Dispersion 1>

A heat-dried two-necked flask equipped with a dropping funnel was charged with 870 parts by mass of n-hexane. A monomer solution was prepared by charging a separate beaker with 42 parts by mass of n-hexane, 52 parts by mass of behenyl acrylate (the acrylate of an alcohol having a linear alkyl group of 22 carbons) and 0.3 parts by mass of azobismethoxydimethylvaleronitrile, and stirring and mixing the beaker contents at 20° C. The monomer solution was then introduced into the dropping funnel. The reaction vessel was flushed with nitrogen, following which, under closed conditions, the monomer solution was added dropwise at 40° C. over a period of 1 hour. Stirring was continued for 3 hours from the end of dropwise addition, after which a mixture of 0.3 parts by mass of azobismethoxydimethylvaleronitrile and 42 parts by mass of n-hexane was again added dropwise and stirring was carried out at 40° C. for 3 hours. The system was then cooled to room temperature, giving Resin Fine Particle Dispersion 1 having a volume-average particle diameter of 200 nm and a solids content of 20 mass %. The maximum endothermic peak for the resin fine particles in this resin fine particle dispersion had a peak temperature of 66° C.

<Preparation of Wax Dispersion 1>

| | |
|---|---|
| Dipentaerythritol palmitic acid ester wax (WAX-1) | 16 parts by mass |
| Nitrile group-containing styrene-acrylic resin (styrene, 60 parts by mass; n-butyl acrylate, 30 parts by mass, acrylonitrile, 10 parts by mass; peak molecular weight, 8,500) | 8 parts by mass |
| Acetone | 76 parts by mass |

The above ingredients were charged into a glass beaker equipped with stirring blades (Iwaki Glass), and the interior of the system was heated to 50° C., thereby dissolving the wax in the acetone. Next, the interior of the system was gradually cooled under gentle stirring at 50 rpm. Cooling was continued down to 25° C. over a period of 3 hours, thereby giving a milky white liquid. This solution was charged, together with 20 parts by mass of 1 mm glass beads, into a heat-resistant vessel, and dispersion was carried out for 3 hours with a paint shaker (Toyo Seiki), giving Wax Dispersion 1.

The size of the wax particles in Wax Dispersion 1, expressed as the volume-average particle diameter, was 0.15 μm. The properties of the Wax Dispersion 1 obtained and the wax used (WAX-1) are shown in Table 3.

<Preparation of Wax Dispersions 2 to 12>

Aside from using the waxes shown in Table 3 (WAX 2 to WAX-12) instead of the dipentaerythritol palmitic acid ester wax (WAX-1) used in Wax Dispersion 1, WAX Dispersions 2 to 12 were prepared in the same way as Wax Dispersion 1. The properties of the resulting Wax Dispersions 2 to 12 and the waxes used (WAX-2 to WAX-12) are shown in Table 3.

<Preparation of Wax Dispersion 13>

| | |
|---|---|
| Dipentaerythritol behenic acid ester wax (WAX-2) | 30.0 parts by mass |
| Nitrile group-containing styrene-acrylic resin (styrene, 60 parts by mass; n-butyl acrylate, 30 parts by mass, acrylonitrile, 10 parts by mass; peak molecular weight, 8,500) | 15.0 parts by mass |
| Cationic surfactant Neogen RK (Dai-Ichi Kogyo Seiyaku) | 5.0 parts by mass |
| Ion-exchanged water | 200.0 parts by mass |

The above ingredients were mixed and heated to 95° C., thoroughly dispersed with an Ultra-Turrax T50 disperser (IKA), then subjected to dispersion treatment in a pressure discharge-type Gaulin homogenizer, giving Wax Dispersion 13 having a volume-average particle diameter of 0.20 μm and a solids content of 20.0 mass %.

<Preparation of Colorant Dispersion 1>

| | |
|---|---|
| C.I. Pigment Blue 15:3 | 100.0 parts by mass |
| Acetone | 150.0 parts by mass |
| Glass beads (1 mm) | 200.0 parts by mass |

The above materials were charged into a heat-resistant glass vessel and dispersion was carried out for 5 hours with a paint shaker, following which the glass beads were removed with a nylon mesh, giving Colorant Dispersion 1.

<Preparation of Colorant Dispersion 2>

| | |
|---|---|
| C.I. Pigment Blue 15:3 | 45.0 parts by mass |
| Ionic surfactant Neogen RK (Dai-Ichi Kogyo Seiyaku) | 5.0 parts by mass |
| Ion-exchanged water | 200.0 parts by mass |
| Glass beads (1 mm) | 250.0 parts by mass |

The above materials were charged into a heat-resistant glass vessel and dispersion was carried out for 5 hours with a paint shaker, following which the glass beads were removed with a nylon mesh, giving Colorant Dispersion 2.

<Production of Carrier A>

After adding 4.0 mass % each of a silane coupling agent (3-(2-aminoethylaminopropyl)trimethoxysilane) to magnetite powder having a number-average particle diameter of 0.25 μm and to hematite powder having a number-average particle diameter of 0.60 μm, high-speed mixing and stirring was carried out at a temperature of at least 100° C. within the vessels, thereby lipophilic treating the respective fine powders.

| | |
|---|---|
| Phenol | 10 parts by mass |
| Formaldehyde solution (formaldehyde, 40 mass %; methanol, 10 mass %; water, 50 mass %) | 6 parts by mass |
| Lipophilic treated magnetite | 63 parts by mass |
| Lipophilic treated hematite | 21 parts by mass |

The above materials, 5 parts by mass of 28% ammonia water and 10 parts by mass of water were placed in a flask, the temperature was raised to and held at 85° C. over a period of 30 minutes under stirring and mixing, and a polymerization reaction and curing were effected for 3 hours. Next, the system was cooled to 30° C. and water was again added, following which the supernatant was removed and the precipitate was rinsed with water then air-dried. Next, the precipitate was dried under reduced pressure (5 mmHg or below) at 60° C., giving spherical magnetic resin particles containing the magnetic bodies in a dispersed state.

A copolymer of methyl methacrylate and methyl methacrylate having perfluoroalkyl groups ($CF_3$—$(CF_2)_m$—, wherein m=7) (copolymerization ratio, 8:1; weight-average molecular weight, 45,000) was used as the coating resin. Next, 10 parts by mass of melamine particles having a number-average particle diameter of 290 nm and 6 parts by mass of carbon particles having a specific resistance of $1\times10^{-2}\Omega\cdot$cm and a number-average particle diameter of 30 nm were added to 100 parts by mass of this coating resin, and dispersed for 30 minutes in an ultrasonic disperser. In addition, a methyl ethyl ketone/toluene mixed solvent coating solution was prepared so as to set the coating resin content with respect to the carrier core to 2.5 parts by mass (solution concentration, 10 mass %).

This coating solution was resin-coated onto the surface of the magnetic resin particles while continuously applying shear stress and evaporating off the solvent at 70° C. The resin-coated magnetic carrier particles were heat-treated at 100° C. while stirring for 2 hours, after which they were cooled and disintegrated, then classified with a 200 mesh screen, thereby giving Carrier A having a number-average particle diameter of 33 μm, a true specific gravity of 3.53 g/cm$^3$, an apparent specific gravity of 1.84 g/cm$^3$, and an intensity of magnetization of 42 Am$^2$/kg.

Example 1

Toner Particle 1 (Before Treatment) Production Step

In the experimental apparatus in FIG. 1, first valves V1 and V2 and pressure regulating valve V3 were closed, Resin Fine Particle Dispersion 1 (referred to in Table 4 as "Resin Fine Particles-1") was charged into a pressure-resistant granulation tank T1 equipped with a filter for collecting toner particles and a stirring mechanism, and the internal temperature was adjusted to 30° C. Next, valve V1 was opened and, using pump P1, carbon dioxide (purity, 99.99%) was introduced from cylinder B1 into the pressure-resistant tank T1. When the internal pressure reached 5 MPa, the valve V1 was closed.

Separately, Block Polymer Resin Solution 1, Wax Dispersion 1, Colorant Dispersion 1 and acetone were charged into a resin solution tank T2, and the internal temperature was adjusted to 30° C.

Next, valve V2 was opened and, while stirring the interior of the granulation tank T1 at 2,000 rpm, the contents of the resin solution tank T2 were introduced into the granulation tank T1 with the pump P2. When introduction of all the contents of tank T2 into tank T1 was complete, valve V2 was closed.

The internal pressure in the granulation tank T1 following such introduction became 8 MPa.

The various materials were charged in the following amounts (mass ratio).

| | |
|---|---|
| Block Polymer Resin Solution 1 | 175.0 parts by mass |
| Wax Dispersion 1 (solids content: WAX-1, 5 parts by mass; nitrile group-containing styrene-acrylic resin (indicated as "Dispersion-1" in Table 4), 2.5 parts by mass) | 31.3 parts by mass |
| Colorant Dispersion 1 | 12.5 parts by mass |
| Acetone | 31.2 parts by mass |
| Resin Fine Particle Dispersion 1 | 25.0 parts by mass |
| Carbon dioxide | 280.0 parts by mass |

The mass of the introduced carbon dioxide was determined by using an equation of state in the literature (*Journal of Physical and Chemical Reference Data*, Vol. 25, pp. 1509-1596) to calculate the carbon dioxide density from the temperature (30° C.) and pressure (8 MPa) of the carbon dioxide, and multiplying this density by the volume of the granulation tank T1.

After introduction of the resin solution tank T2 contents into the granulation tank T1 was completed, granulation was carried out by stirring at 2,000 rpm for another 3 minutes.

Next, valve V1 was opened and carbon dioxide was introduced from cylinder B1 into the granulation tank T1 using pump P1. At this time, the pressure regulating valve V3 was set to 10 MPa and, while holding the internal pressure of the granulation tank T1 at 10 MPa, additional carbon dioxide was passed through. By means of this operation, organic solvent (primarily acetone)-containing carbon dioxide extracted from the liquid drops following granulation was discharged into a solvent recovery tank T3, and the organic solvent and carbon dioxide were separated.

Carbon dioxide introduction into the granulation tank T1 was stopped when the amount introduced reached five times the mass of carbon dioxide initially introduced into the granulation tank T1. At this point, the operation of replacing the organic solvent-containing carbon dioxide with carbon dioxide containing no organic solvent was completed.

In addition, by opening pressure regulating valve V3 a little at a time, and reducing the internal pressure of the granulation tank T1 to atmospheric pressure, the Toner Particles 1 (before treatment) collected by the filter were recovered. The resulting Toner Particles 1 (before treatment) were subjected to DSC measurement, whereupon the peak temperature (Tp) of the maximum endothermic peak from the binder resin was found to be 58° C.

Annealing Treatment Step:

Annealing treatment was carried out using a thermostatic dryer (41-S5, manufactured by Satake Chemical Equipment Mfg.). The internal temperature of the thermostatic dryer was adjusted to 50° C.

The above Toner Particles 1 (before treatment) were spread out uniformly within a stainless steel vat, which was then placed in the thermostatic dryer, left to stand for 2 hours and subsequently taken out, thereby giving annealed Toner Particles 1 (after treatment).

<Preparation of Toner 1>

Next, 0.9 parts by mass of anatase-type titanium oxide fine powder (BET specific surface area, 80 $m^2/g$; number-average particle diameter (D1), 15 nm; 12 mass % isobutyltrimethoxysilane-treated) was externally added with a Henschel mixer (FM-10B, from Mitsui Miike Chemical Engineering Machinery) per 100.0 parts by mass of the above Toner Particles 1 (after treatment). This was followed by the additional mixture, with the same Henschel mixer, of 1.2 parts by mass of oil-treated silica fine particles (BET specific surface area, 95 $m^2/g$; 15% silicone oil-treated) and 1.5 parts by mass of sol-gel silica fine particles (BET specific surface area, 24 $m^2/g$; number-average particle diameter (D1), 110 nm), thereby giving Toner 1. DSC measurement of the resulting Toner 1 (after treatment) was carried out, and the peak temperature (Tp) of the maximum endothermic peak from the binder resin was determined to be 61° C. The Toner 1 production conditions and properties are shown in Tables 4 and 5. The results of evaluations carried out as described below are shown in Table 6.

<Evaluation of Heat-Resistant Storage Stability>

About 10 g of Toner 1 was placed in a 100 mL plastic cup, held at 50° C. for 3 days and at 53° C. for 3 days, then visually evaluated.

<Evaluation Criteria>

A: No clumps whatsoever are observable; toner is substantially in the same state as initially.

B: The toner shows some tendency for clumping but because the clumps break down when the cup is lightly shaken about five times, this presents no particular problem C: The toner shows some tendency for clumping but because the clumps are easily broken up by finger, the toner is suitable for actual use.

D: Severe clumping arises.

E: The toner solidifies, becoming impossible to use.

<Evaluation of Heat-Resistant Storage Stability After Heat Cycling Test>

Figure 2:
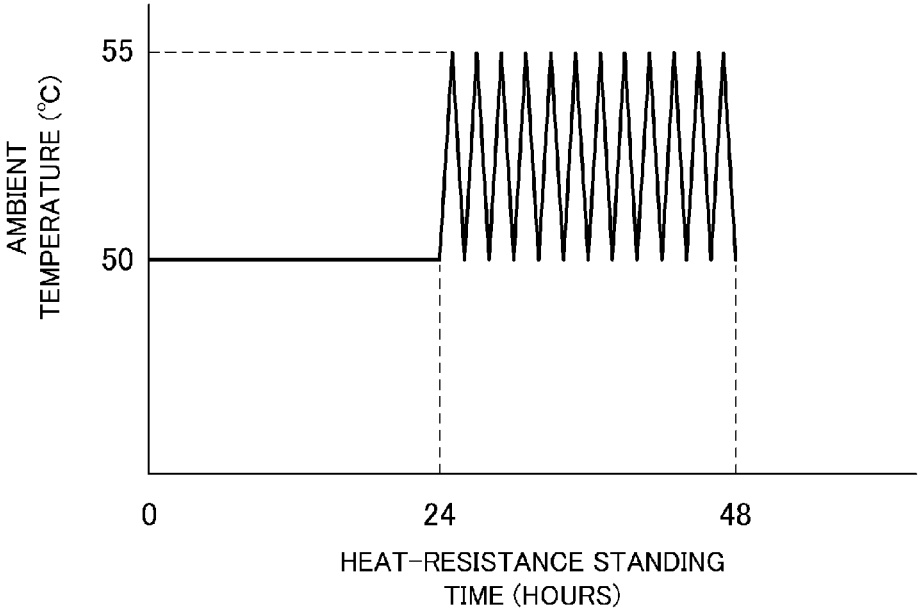
FIG. 2 shows is a time chart in a toner heat cycling test.

About 10 g of Toner 1 was placed in a 100 mL plastic cup and held at 50° C. for 1 day, then 12 cycles each of which entailed changing the temperature between 50° C. and 53° C. at a rate of 1° C./hour were carried out over 3 days, following which the toner was removed and checked for clumping. A time chart of the heat cycling test is shown in FIG. 2

<Evaluation Criteria of Heat-Resistant Storage Stability>

A: No clumps whatsoever are observable; toner is substantially in the same state as initially.

B: The toner shows some tendency for clumping but because the clumps break down when the cup is lightly shaken about five times, this presents no particular problem C: The toner shows some tendency for clumping but because the clumps are easily broken up by finger, the toner is suitable for actual use.

D: Severe clumping arises.

E: The toner solidifies, becoming impossible to use.

<Evaluation of Charge Retention After Heat Cycling Test>

Toner on which the above heat cycling test had not been carried out was held for 1 day in a normal temperature, normal humidity environment (temperature, 23° C.; humidity, 60%) and furnished as standard toner. The toner which had been subjected to the heat cycling test was passed through a 200 mesh (75-μm openings) screen, held for one day in a normal temperature, normal humidity environment (temperature, 23° C.; humidity, 60%), and furnished as sample toner.

The toner and a carrier (a standard carrier of The Imaging Society of Japan: N-01, a spherical carrier composed of surface-treated ferrite cores) were placed, in respective amounts of 1.0 g and 19.0 g, in a plastic bottle with a cap, and held for one day in the measuring environment. The plastic bottle in which the toner and carrier had been placed was set in a shaker (YS-LD, manufactured by Yayoi) and shaken for 1 minute at a speed of 4 cycles per second, thereby charging the developer composed of the toner and the carrier.

Figure 3:
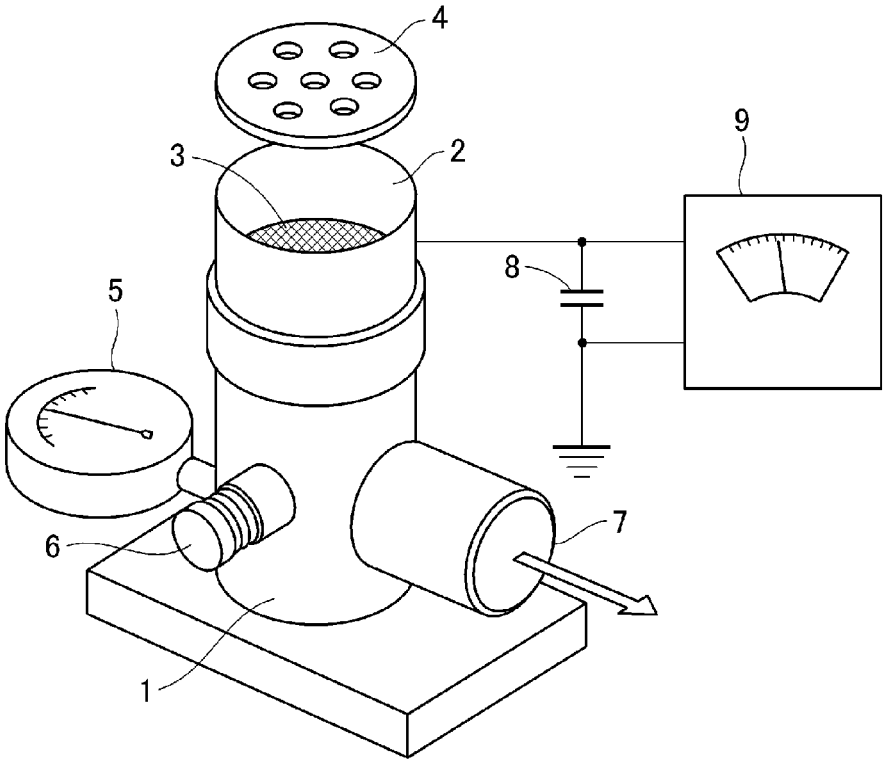
FIG. 3 is a schematic diagram showing an apparatus for measuring the triboelectric charge quantity.

Next, the triboelectric charge quantity was measured using the triboelectric charge quantity measuring apparatus shown in FIG. 3. Referring to FIG. 3, about 0.5 to 1.5 g of the above developer was placed in a metal measuring vessel 2 having a 500 mesh (25-μm openings) screen 3 on the bottom, and a metal cover 4 was placed thereon. The mass of the entire measuring vessel 2 at this time was weighed as W1 (g). Next, in a suction device 1 (at least that portion of which is in contact with the measurement vessel 2 being an insulating body), suction was carried out through a suction port 7, the pressure at a vacuum gauge 5 being set to 250 mmAq by adjusting an air flow regulating valve 6. Suction was carried out in this state for 2 minutes, thereby aspirating and removing the toner. The potential on an electrometer 9 was set in volts (V). Here, 8 is a capacitor having a capacitance of C (mF). The mass of the entire measuring apparatus following aspiration was weighted as W2 (g). The triboelectric charge quantity (mC/kg) of this sample was computed as follows.

$$\text{Triboelectric charge quantity of sample(mC/kg)} = C \times V / (W1 - W2)$$

<Evaluation Criteria of Charge Retention>

A: Difference between charge quantity of sample toner and charge quantity of standard toner was less than 5%.

B: Difference between charge quantity of sample toner and charge quantity of standard toner was at least 5% but less than 10%.

C: Difference between charge quantity of sample toner and charge quantity of standard toner was at least 10% but less than 20%.

D: Difference between charge quantity of sample toner and charge quantity of standard toner was 20% or more.

E: The sample toner clumped and solidified, making the charge impossible to evaluate.

This evaluation assesses the state of bleedout by low-molecular-weight components and wax in the cores making up the toner particles.

<Evaluation of Low-Temperature Fixability>

The low-temperature fixability of the toner was evaluated by two different methods: the fixing onset temperature by peel property and the fixing onset temperature by cold offsetting.

<Evaluation of Fixing Onset Temperature by Peel Property>

Two-Component Developer 1 was prepared by mixing together 8.0 parts by mass of above Toner 1 and 92.0 parts by mass of the Carrier A produced as described above.

The above Two-Component Developer 1 and a CLC 5000 (Canon) color laser copier were used for evaluation. The development contrast on the above copier was adjusted so that the toner laid-on level on the paper was 1.2 mg/cm$^2$, and a "solid" unfixed image having an end margin of 5 mm, a width of 100 mm and a length of mm was produced in a normal temperature, normal humidity environment (23° C./60% RH). The paper used was heavy A4 paper (Plover Bond Paper, 105 g/m$^2$, available from Fox River).

Next, an LBP 5900 (Canon) fixing unit was modified to enable the fixing temperature to be manually set, the rotational speed of the fixing unit was changed to 270 mm/s, and the nip pressure was set to 120 kPa. The modified fixing unit was used in a normal temperature, normal humidity environment (23° C./60% RH) and, while raising the fixing temperature at intervals of 10° C. in the range of 80° C. to 180° C., the above "solid" unfixed images were fixed at the respective temperatures, thereby giving fixed images.

A soft thin paper (available under the trade name "Dusper" from Ozu Corporation) was covered over the image regions of the resulting fixed images, and a 4.9 kPa load was placed on the paper and rubbed back-and-forth five times over the image region. The image density was measured before rubbing and was measured again after rubbing, and the percent decrease in image density (ΔD (%)) due to peeling was calculated from the following formula. This ratio ΔD (%) was rated according to the following criteria by treating the temperature when this ratio ΔD (%) was less than 10% as the fixing onset temperature based on peel property.

The image density was measured with a color reflection densitometer (X-Rite 404A, manufactured by X-Rite).

$$\Delta D(\%)=[((\text{image density before rubbing})-(\text{image density after rubbing}))/(\text{image density before rubbing})]\times 100$$

<Evaluation Criteria>

A: Fixing onset temperature was 100° C. or below
B: Fixing onset temperature was 110° C.
C: Fixing onset temperature was 120° C.
D: Fixing onset temperature was 130° C.
E: Fixing onset temperature was 140° C. or more In this invention, a rating of up to C was regarded to be a good low-temperature fixability.

<Evaluation of Fixing Onset Temperature by Cold Offsetting (C.O.)>

An evaluation of cold offset was carried out using the fixed images obtained in the above evaluation of the fixing onset temperature by peel property. Evaluation was carried out by checking the change in density in a region that becomes white background in the back of one cycle of the fixing belt from the end of the "solid" image in the circumferential direction. A TC-6DS densitometer (manufactured by Tokyo Denshoku Gijutsu Center) was used to measure the reflectance (%); this was used as the density value. The point at which the density had changed 0.5% was treated as the point at which cold offset occurred, and the lowest temperature at which cold offset did not occur was treated as the fixing onset temperature by cold offsetting.

<Evaluation Criteria>

A: Fixing onset temperature was 100° C. or below
B: Fixing onset temperature was 110° C.
C: Fixing onset temperature was 120° C.
D: Fixing onset temperature was 130° C.
E: Fixing onset temperature was 140° C. or more In this invention, a rating of up to C was regarded as a good cold offset property.

<Evaluation of Fixing Region>

From the above evaluations of the low-temperature fixability, the paper was changed to standard A4 paper (Office Planner, 64 g/m$^2$, available from Canon), and evaluation of the fixability was carried out. From a fixed image, the point at which high-temperature offset toner from the preceding cycle was visually observed in the second fixing unit cycle was treated as the high-temperature offset starting temperature, and the highest temperature of the temperatures below the high-temperature offset starting temperature was treated as the high-temperature fixing temperature. In those cases where high-temperature offset did not occur up to 180° C., 180° C. was treated as the high-temperature fixing temperature.

The higher of the fixing onset temperature by Peel property and the fixing onset temperature by cold offset was treated as the fixing onset temperature, and the difference between the fixing onset temperature and the high-temperature fixing temperature (high-temperature fixing temperature fixing onset temperature) was taken to be the fixing region. This was rated as follows.

<Evaluation Criteria>

A: Fixing region is 70° C. or above
B: Fixing region is 60° C.
C: Fixing region is 50° C.
D: Fixing region is 40° C.
E: Fixing region is 30° C. or below

Comparative Example 1

Toner Particle 2 (before treatment) Production Step

| | |
|---|---|
| Crystalline Polyester Resin Dispersion 1 | 159.7 parts by mass |
| Non-Crystalline Resin Dispersion 1 | 68.6 parts by mass |
| Colorant Dispersion 2 | 27.8 parts by mass |
| Wax Dispersion 13 | 41.7 parts by mass |
| Aluminum polychloride | 0.41 parts by mass |

The above ingredients were placed in a round-bottomed stainless steel flask, and thoroughly mixed and dispersed with an Ultra-Turrax T50. Next, 0.36 parts by mass of aluminum polychloride was added, and the dispersion operation with the Ultra-Turrax T50 was continued. The flask was heated to 47° C. under stirring on an oil bath and this temperature was held for 60 minutes, following which 13.0 parts by mass of the Non-Crystalline Resin Dispersion 1 was slowly added thereto. Next, the pH inside the system was adjusted to 5.4 with a 0.5 mol/L aqueous solution of sodium hydroxide, following which the stainless steel flask was closed and, using a magnetic seal, was heated to 96° C. and held at that temperature for 5 hours under continued stirring.

Following reaction completion, cooling, filtration and thorough washing with ion-exchange water were carried out, after which solid-liquid separation was effected by Buchner-vacuum filtration. The product was re-dispersed in 3 L of 40° C. ion-exchanged water, and stirred and washed for 15 minutes at 300 rpm. This was repeated another five times and when the pH of the filtrate reached 7.0, solid-liquid separation was carried out by Buchner vacuum filtration using No. 5A filter paper. Next, vacuum drying was continued for 12 hours, giving Toner Particles 2 (before treatment). In DSC measurement of the resulting Toner Particles 2, the peak temperature of the maximum endothermic peak from the binder resin was 58° C.

<Annealing Treatment Step>

Annealing treatment was carried out using a thermostatic dryer (41-S5, manufactured by Satake Chemical Equipment Mfg.). The internal temperature of the thermostatic dryer was adjusted to 50° C.

The above Toner Particles 2 (before treatment) were spread out uniformly within a stainless steel vat, which was then placed in the thermostatic dryer, left to stand for 2 hours and subsequently taken out, thereby giving annealed Toner Particles 2 (after treatment).

<Preparation of Toner 2>

Next, the same operations were carried on the above Toner Particles 2 (after treatment) as in the Preparation of Toner 1 in Example 1, giving Toner 2. DSC measurement of the resulting Toner 2 (after treatment) was carried out, and the peak temperature (Tp) of the maximum endothermic peak from the binder resin was determined to be 61° C. The Toner 2 production conditions and properties are shown in Tables 4 and 5. The results of evaluations carried out by the same methods as in Example 1 are shown in Table 6.

Comparative Examples 2 to 6

Aside from selecting the block polymer resin solution and the wax dispersion so that the block polymer and wax in the Toner Particle 1 (before treatment) production step become the block polymer and wax shown in Table 4, Toners 3 to 7 were obtained in the same way as in Example 1. The toner production conditions and properties are shown in Tables 4 and 5. The results of evaluations are shown in Table 6.

Examples 2 to 24

Aside from selecting the block polymer resin solution and the wax dispersion so that the block polymer and wax in the Toner Particle 1 (before treatment) production step become the block polymer and wax shown in Table 4, Toners 8 to 30 were obtained in the same way as in Example 1. The toner production conditions and properties are shown in Tables 4 and 5. The results of evaluations are shown in Table 6.

In Toners 9, 11, 17 and 20 according to Examples 3, 5, 11 and 14, on the toner endothermic quantity curves, the endothermic peak for wax overlapped with the maximum endothermic peak from the binder resin. As a result, in each of these cases, the value obtained by subtracting the endothermic quantity for wax from the endothermic quantity for the maximum endothermic peak was determined as the endothermic quantity for the maximum endothermic peak from the binder resin. Also, in toners 1, 2, 5, 11 to 15, 17 to 28 and 30 according to examples of the invention, on the toner endothermic quantity curves, the endothermic peaks for the resin in the shell phase formed by resin fine particles in the toner overlapped with the maximum endothermic peak from the binder resin. As a result, in each of these cases, the value obtained by subtracting the endothermic quantity for resin in the shell phase from the endothermic quantity for the maximum endothermic peak was determined as the endothermic quantity for the maximum endothermic peak from the binder resin.

In examples other than the foregoing, the maximum endothermic peak in the endothermic quantity curve for the toner was determined directly as the maximum endothermic peak from the binder resin.

TABLE 1

| | Mn | Mw | Tp (° C.) |
|---|---|---|---|
| Crystalline polyester 1 | 5,100 | 11,500 | 66 |
| Crystalline polyester 2 | 4,900 | 10,300 | 50 |
| Crystalline polyester 3 | 5,100 | 10,700 | 87 |
| Crystalline polyester 4 | 5,300 | 11,500 | 58 |
| Crystalline polyester 5 | 5,000 | 11,200 | 83 |
| Crystalline polyester 6 | 5,000 | 11,600 | 61 |
| Crystalline polyester 7 | 4,600 | 10,500 | 74 |
| Crystalline polyester 8 | 12,700 | 59,000 | 65 |

TABLE 2

| | Segments capable of forming a crystalline structure | | Diisocyanate *1) | | Added ingredients *2) | | Modifier | |
|---|---|---|---|---|---|---|---|---|
| | Type | Amount added (parts by mass) | Type | Amount added (parts by mass) | Type | Amount added (parts by mass) | Type | Amount added (parts by mass) |
| Block polymer 1 | Crystalline polyester 1 | 210.0 | XDI | 56.0 | CHDM | 34.0 | t-butyl alcohol | 3.0 |
| Block polymer 2 | Crystalline polyester 2 | 210.0 | XDI | 56.0 | CHDM | 34.0 | t-butyl alcohol | 3.0 |
| Block polymer 3 | Crystalline polyester 3 | 210.0 | XDI | 56.0 | CHDM | 34.0 | t-butyl alcohol | 3.0 |
| Block polymer 4 | Crystalline polyester 1 | 135.0 | XDI | 97.0 | CHDM | 68.0 | t-butyl alcohol | 3.0 |
| Block polymer 5 | Crystalline polyester 4 | 210.0 | XDI | 56.0 | CHDM | 34.0 | t-butyl alcohol | 3.0 |
| Block polymer 6 | Crystalline polyester 5 | 210.0 | XDI | 56.0 | CHDM | 34.0 | t-butyl alcohol | 3.0 |
| Block polymer 7 | Crystalline polyester 6 | 210.0 | XDI | 56.0 | CHDM | 34.0 | t-butyl alcohol | 3.0 |
| Block polymer 8 | Crystalline polyester 7 | 210.0 | XDI | 56.0 | CHDM | 34.0 | t-butyl alcohol | 3.0 |

TABLE 2-continued

| | | | | | | | | |
|---|---|---|---|---|---|---|---|---|
| Block polymer 9 | Crystalline polyester 1 | 156.0 | XDI | 86.0 | CHDM | 58.0 | t-butyl alcohol | 3.0 |
| Block polymer 10 | Crystalline polyester 1 | 252.0 | XDI | 33.0 | CHDM | 15.0 | t-butyl alcohol | 3.0 |
| Block polymer 11 | Crystalline polyester 1 | 183.0 | XDI | 71.0 | CHDM | 46.0 | t-butyl alcohol | 3.0 |
| Block polymer 12 | Crystalline polyester 1 | 234.0 | XDI | 43.0 | CHDM | 23.0 | t-butyl alcohol | 3.0 |

| | Content of segments | Properties of block polymer | | | | |
|---|---|---|---|---|---|---|
| | capable of forming a crystalline structure, mass % | Mn | Mw | Tp ° C. | Urethane bond concentration, mmol/g | Storage elastic modulus G'(Tp + 25), Pa |
| Block polymer 1 | 69 | 14,600 | 33,100 | 58 | 1.98 | $3.2 \times 10^4$ |
| Block polymer 2 | 69 | 15,900 | 35,600 | 42 | 1.98 | $4.2 \times 10^4$ |
| Block polymer 3 | 69 | 14,600 | 32,100 | 79 | 1.98 | $2.8 \times 10^4$ |
| Block polymer 4 | 45 | 17,400 | 39,400 | 58 | 3.44 | $2.1 \times 10^5$ |
| Block polymer 5 | 69 | 13,600 | 30,200 | 50 | 1.98 | $3.8 \times 10^4$ |
| Block polymer 6 | 69 | 15,200 | 33,900 | 75 | 1.98 | $2.9 \times 10^4$ |
| Block polymer 7 | 69 | 15,200 | 33,000 | 53 | 1.98 | $3.5 \times 10^4$ |
| Block polymer 8 | 69 | 18,600 | 38,600 | 66 | 1.98 | $3.0 \times 10^4$ |
| Block polymer 9 | 51 | 12,500 | 29,100 | 58 | 3.04 | $9.1 \times 10^4$ |
| Block polymer 10 | 83 | 13,700 | 32,100 | 58 | 1.18 | $1.7 \times 10^3$ |
| Block polymer 11 | 60 | 13,400 | 31,400 | 58 | 2.50 | $6.8 \times 10^4$ |
| Block polymer 12 | 77 | 13,000 | 30,300 | 58 | 1.52 | $2.3 \times 10^3$ |

*1) XDI stands for xylylene diisocyanate.

*2) CHDM stands for cyclohexanedimethanol, and PG stands for propylene glycol.

TABLE 3

| | WAX | Type | Volume-average particle diameter (μm) | Number of functional groups | Melting point, ° C. | Saponification value, mgKOH/g | Molecular weight |
|---|---|---|---|---|---|---|---|
| Wax Dispersion 1 | WAX-1 | Dipentaerythritol palmitic acid ester | 0.15 | 6 | 72 | 200 | 1682 |
| Wax Dispersion 2 | WAX-2 | Dipentaerythritol behenic acid ester | 0.16 | 6 | 82 | 154 | 2186 |
| Wax Dispersion 3 | WAX-3 | Pentaerythritol palmitic acid ester | 0.18 | 4 | 69 | 206 | 1088 |
| Wax Dispersion 4 | WAX-4 | Behenyl behenate | 0.17 | 1 | 71 | 87 | 648 |
| Wax Dispersion 5 | WAX-5 | Dibehenyl sebacate | 0.14 | 2 | 73 | 137 | 818 |
| Wax Dispersion 6 | WAX-6 | Glycerol tribehenate | 0.15 | 3 | 70 | 159 | 1058 |
| Wax Dispersion 7 | WAX-7 | Pentaerythritol myristic acid ester | 0.16 | 4 | 62 | 231 | 972 |
| Wax Dispersion 8 | WAX-8 | Pentaerythritol stearic acid ester | 0.15 | 4 | 76 | 187 | 1200 |
| Wax Dispersion 9 | WAX-9 | Dipentaerythritol myrisitic acid ester | 0.18 | 6 | 64 | 222 | 1514 |
| Wax Dispersion 10 | WAX-10 | Dipentaerythritol stearic acid ester | 0.17 | 6 | 77 | 182 | 1850 |
| Wax Dispersion 11 | WAX-11 | Tristearyl trimellitate | 0.22 | 3 | 70 | 174 | 966 |
| Wax Dispersion 12 | WAX-12 | Diglycerol tetrabehenate | 0.21 | 4 | 70 | 154 | 1454 |
| Wax Dispersion 13 | WAX-2 | Dipentaerythritol behenic acid ester | 0.20 | 6 | 82 | 154 | 2186 |

TABLE 4

| | Binder resin | | Pigment | | Wax | | Wax dispersion *1) | | Shell agent | |
|---|---|---|---|---|---|---|---|---|---|---|
| | Type | Amount | Type | Amount | Type | Amount | Type | Amount | Type | Amount |
| Toner 1 | Block Polymer 1 | 87.5 | PB-15:3 | 5.0 | WAX-1 | 5.0 | Dispersion 1 | 2.5 | Resin Fine Particles 1 | 5.0 |
| Toner 2 | Crystalline Polyester 8, Non-Crystalline Resin 1 | 61.2<br>26.3 | PB-15:3 | 5.0 | WAX-2 | 5.0 | Dispersion 1 | 2.5 | Resin Fine Particles 1 | 5.0 |
| Toner 3 | Block Polymer 2 | 87.5 | PB-15:3 | 5.0 | WAX-3 | 5.0 | Dispersion 1 | 2.5 | Resin Fine Particles 1 | 5.0 |
| Toner 4 | Block Polymer 3 | 87.5 | PB-15:3 | 5.0 | WAX-3 | 5.0 | Dispersion 1 | 2.5 | Resin Fine Particles 1 | 5.0 |
| Toner 5 | Block Polymer 4 | 87.5 | PB-15:3 | 5.0 | WAX-3 | 5.0 | Dispersion 1 | 2.5 | Resin Fine Particles 1 | 5.0 |
| Toner 6 | Block Polymer 1 | 87.5 | PB-15:3 | 5.0 | WAX-4 | 5.0 | Dispersion 1 | 2.5 | Resin Fine Particles 1 | 5.0 |
| Toner 7 | Block Polymer 1 | 87.5 | PB-15:3 | 5.0 | WAX-5 | 5.0 | Dispersion 1 | 2.5 | Resin Fine Particles 1 | 5.0 |

TABLE 4-continued

| | Binder resin | | Pigment | | Wax | | Wax dispersion *1) | | Shell agent | |
|---|---|---|---|---|---|---|---|---|---|---|
| | Type | Amount | Type | Amount | Type | Amount | Type | Amount | Type | Amount |
| Toner 8 | Block Polymer 5 | 87.5 | PB-15:3 | 5.0 | WAX-1 | 5.0 | Dispersion 1 | 2.5 | Resin Fine Particles 1 | 5.0 |
| Toner 9 | Block Polymer 6 | 87.5 | PB-15:3 | 5.0 | WAX-1 | 5.0 | Dispersion 1 | 2.5 | Resin Fine Particles 1 | 5.0 |
| Toner 10 | Block Polymer 7 | 87.5 | PB-15:3 | 5.0 | WAX-1 | 5.0 | Dispersion 1 | 2.5 | Resin Fine Particles 1 | 5.0 |
| Toner 11 | Block Polymer 8 | 87.5 | PB-15:3 | 5.0 | WAX-1 | 5.0 | Dispersion 1 | 2.5 | Resin Fine Particles 1 | 5.0 |
| Toner 12 | Block Polymer 9 | 87.5 | PB-15:3 | 5.0 | WAX-1 | 5.0 | Dispersion 1 | 2.5 | Resin Fine Particles 1 | 5.0 |
| Toner 13 | Block Polymer 10 | 87.5 | PB-15:3 | 5.0 | WAX-1 | 5.0 | Dispersion 1 | 2.5 | Resin Fine Particles 1 | 5.0 |
| Toner 14 | Block Polymer 11 | 87.5 | PB-15:3 | 5.0 | WAX-1 | 5.0 | Dispersion 1 | 2.5 | Resin Fine Particles 1 | 5.0 |
| Toner 15 | Block Polymer 12 | 87.5 | PB-15:3 | 5.0 | WAX-1 | 5.0 | Dispersion 1 | 2.5 | Resin Fine Particles 1 | 5.0 |
| Toner 16 | Block Polymer 1 | 87.5 | PB-15:3 | 5.0 | WAX-6 | 5.0 | Dispersion 1 | 2.5 | Resin Fine Particles 1 | 5.0 |
| Toner 17 | Block Polymer 1 | 87.5 | PB-15:3 | 5.0 | WAX-7 | 5.0 | Dispersion 1 | 2.5 | Resin Fine Particles 1 | 5.0 |
| Toner 18 | Block Polymer 1 | 87.5 | PB-15:3 | 5.0 | WAX-3 | 5.0 | Dispersion 1 | 2.5 | Resin Fine Particles 1 | 5.0 |
| Toner 19 | Block Polymer 1 | 87.5 | PB-15:3 | 5.0 | WAX-8 | 5.0 | Dispersion 1 | 2.5 | Resin Fine Particles 1 | 5.0 |
| Toner 20 | Block Polymer 1 | 87.5 | PB-15:3 | 5.0 | WAX-9 | 5.0 | Dispersion 1 | 2.5 | Resin Fine Particles 1 | 5.0 |
| Toner 21 | Block Polymer 1 | 87.5 | PB-15:3 | 5.0 | WAX-10 | 5.0 | Dispersion 1 | 2.5 | Resin Fine Particles 1 | 5.0 |
| Toner 22 | Block Polymer 1 | 87.5 | PB-15:3 | 5.0 | WAX-2 | 5.0 | Dispersion 1 | 2.5 | Resin Fine Particles 1 | 5.0 |
| Toner 23 | Block Polymer 1 | 92.3 | PB-15:3 | 5.0 | WAX-3 | 1.8 | Dispersion 1 | 0.9 | Resin Fine Particles 1 | 5.0 |
| Toner 24 | Block Polymer 1 | 80.0 | PB-15:3 | 5.0 | WAX-3 | 10.0 | Dispersion 1 | 5.0 | Resin Fine Particles 1 | 5.0 |
| Toner 25 | Block Polymer 1 | 91.7 | PB-15:3 | 5.0 | WAX-3 | 2.2 | Dispersion 1 | 1.1 | Resin Fine Particles 1 | 5.0 |
| Toner 26 | Block Polymer 1 | 82.7 | PB-15:3 | 5.0 | WAX-3 | 8.2 | Dispersion 1 | 4.1 | Resin Fine Particles 1 | 5.0 |
| Toner 27 | Block Polymer 1 | 90.2 | PB-15:3 | 5.0 | WAX-1 | 3.2 | Dispersion 1 | 1.6 | Resin Fine Particles 1 | 5.0 |
| Toner 28 | Block Polymer 1 | 85.7 | PB-15:3 | 5.0 | WAX-1 | 6.2 | Dispersion 1 | 3.1 | Resin Fine Particles 1 | 5.0 |
| Toner 29 | Block Polymer 1 | 87.5 | PB-15:3 | 5.0 | WAX-11 | 5.0 | Dispersion 1 | 2.5 | Resin Fine Particles 1 | 5.0 |
| Toner 30 | Block Polymer 1 | 87.5 | PB-15:3 | 5.0 | WAX-12 | 5.0 | Dispersion 1 | 2.5 | Resin Fine Particles 1 | 5.0 |

*1) "Dispersion 1" represents a nitrile group-containing styrene-acrylic resin (styrene, 60 parts by mass; n-butyl acrylate, 30 parts by mass; acrylonitrile, 10 parts by mass; peak molecular weight, 8,500)

TABLE 5

| | Tp of toner particles (before treatment), ° C. | Annealing conditions | | Tp of toner particles (after treatment), ° C. | Endothermic quantity ΔH of toner particles (after treatment), J/g *2) | Particle diameter D4 of toner particles (after treatment), μm |
|---|---|---|---|---|---|---|
| | | Temperature, ° C. | Time, h | | | |
| Toner 1 | 58 | 50 | 2 | 61 | 42 | 5.8 |
| Toner 2 | 58 | 50 | 2 | 61 | 42 | 5.8 |
| Toner 3 | 42 | 34 | 2 | 44 | 42 | 5.8 |
| Toner 4 | 79 | 71 | 2 | 81 | 42 | 5.8 |
| Toner 5 | 58 | 50 | 2 | 61 | 26 | 5.8 |
| Toner 6 | 58 | 50 | 2 | 60 | 42 | 5.8 |
| Toner 7 | 58 | 50 | 2 | 60 | 42 | 5.8 |
| Toner 8 | 50 | 42 | 2 | 52 | 42 | 5.8 |
| Toner 9 | 75 | 67 | 2 | 77 | 42 | 5.8 |
| Toner 10 | 53 | 45 | 2 | 55 | 42 | 5.8 |
| Toner 11 | 66 | 58 | 2 | 68 | 42 | 5.8 |
| Toner 12 | 58 | 50 | 2 | 61 | 32 | 5.8 |
| Toner 13 | 58 | 50 | 2 | 61 | 84 | 5.8 |
| Toner 14 | 58 | 50 | 2 | 61 | 36 | 5.8 |
| Toner 15 | 58 | 50 | 2 | 61 | 78 | 5.8 |
| Toner 16 | 58 | 50 | 2 | 60 | 42 | 5.8 |
| Toner 17 | 58 | 50 | 2 | 61 | 42 | 5.8 |
| Toner 18 | 58 | 50 | 2 | 61 | 42 | 5.8 |
| Toner 19 | 58 | 50 | 2 | 61 | 42 | 5.8 |
| Toner 20 | 58 | 50 | 2 | 61 | 42 | 5.8 |
| Toner 21 | 58 | 50 | 2 | 61 | 42 | 5.8 |
| Toner 22 | 58 | 50 | 2 | 61 | 42 | 5.8 |
| Toner 23 | 58 | 50 | 2 | 61 | 42 | 5.8 |
| Toner 24 | 58 | 50 | 2 | 61 | 42 | 5.8 |
| Toner 25 | 58 | 50 | 2 | 61 | 42 | 5.8 |
| Toner 26 | 58 | 50 | 2 | 61 | 42 | 5.8 |
| Toner 27 | 58 | 50 | 2 | 61 | 42 | 5.8 |
| Toner 28 | 58 | 50 | 2 | 61 | 42 | 5.8 |
| Toner 29 | 58 | 50 | 2 | 60 | 42 | 5.8 |
| Toner 30 | 58 | 50 | 2 | 61 | 42 | 5.8 |

*2) Endothermic quantity ΔH (J/g) of maximum endothermic peak from binder resin of toner particles (after treatment)

In Table 5, "Tp of toner particles (after treatment)" refers to the Tp from the binder resin of the toner, and "Endothermic quantity of maximum endothermic peak from binder resin of toner particles (after treatment)" refers to the endothermic quantity of the maximum endothermic peak from the binder resin of the toner.

TABLE 6

| | | Heat-resistant storage stability | | Heat cycling test | | | Fixing onset temperature | | |
|---|---|---|---|---|---|---|---|---|---|
| | Toner | 50° C./ 3 days | 53° C./ 3 days | Heat-resistant storage stability | Charge retention | Difference in charge quantities, % | peel property | C.O. | Evaluation of fixing region |
| Example 1 | Toner 1 | A | A | A | A | 1.5 | A | A | A |
| Example 2 | Toner 8 | B | C | C | A | 3.7 | A | A | A |
| Example 3 | Toner 9 | A | A | A | A | 0.9 | C | C | A |
| Example 4 | Toner 10 | A | B | B | A | 2.8 | A | A | A |
| Example 5 | Toner 11 | A | A | A | A | 1.1 | B | B | A |
| Example 6 | Toner 12 | A | A | A | A | 1.8 | C | C | A |
| Example 7 | Toner 13 | A | A | A | A | 1.7 | A | A | C |
| Example 8 | Toner 14 | A | A | A | A | 1.4 | B | B | A |
| Example 9 | Toner 15 | A | A | A | A | 1.6 | A | A | B |
| Example 10 | Toner 16 | A | B | C | C | 17.1 | A | A | A |
| Example 11 | Toner 17 | A | B | B | B | 8.2 | A | A | A |
| Example 12 | Toner 18 | A | A | A | B | 7.6 | A | A | A |
| Example 13 | Toner 19 | A | A | A | B | 6.2 | A | A | A |
| Example 14 | Toner 20 | A | B | B | A | 4.3 | A | A | A |
| Example 15 | Toner 21 | A | A | A | A | 1.5 | A | A | A |
| Example 16 | Toner 22 | A | A | A | A | 1.0 | A | B | A |
| Example 17 | Toner 23 | A | A | A | A | 1.8 | A | C | C |
| Example 18 | Toner 24 | A | A | A | C | 17.5 | A | A | A |
| Example 19 | Toner 25 | A | A | A | B | 5.6 | A | B | B |
| Example 20 | Toner 26 | A | A | A | B | 7.1 | A | A | A |
| Example 21 | Toner 27 | A | A | A | A | 2.3 | A | A | A |
| Example 22 | Toner 28 | A | A | A | A | 3.1 | A | A | A |
| Example 23 | Toner 29 | A | B | C | C | 13.6 | A | A | A |
| Example 24 | Toner 30 | A | A | B | B | 8.7 | A | A | A |
| Comparative Example 1 | Toner 2 | A | A | A | A | 2.8 | A | B | D |
| Comparative Example 2 | Toner 3 | D | E | E | B | 8.6 | A | A | A |
| Comparative Example 3 | Toner 4 | A | A | A | B | 5.2 | D | D | A |
| Comparative Example 4 | Toner 5 | A | A | A | B | 5.6 | D | D | A |
| Comparative Example 5 | Toner 6 | A | B | E | E | Could not be determined | A | A | A |
| Comparative Example 6 | Toner 7 | A | C | D | E | Could not be determined | A | A | A |

REFERENCE SIGNS LIST

1: Suction device (at least that portion in contact with measurement vessel 2 is an insulating body), 2: Metal measurement vessel, 3: 500-mesh screen, 4: Metal cover, 5: Vacuum gauge, 6: Air flow adjusting valve, 7: Suction port, 8: Capacitor, 9: Electrometer, T1: Granulating tank, T2: Resin solution tank, T3: Solvent recovery tank, B1: Carbon dioxide cylinder, P1 and P2: Pumps, V1 and V2: valves, V3: Pressure regulating valve While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-125760, filed on Jun. 3, 2011, which is hereby incorporated by reference herein in its entirety.

What is claimed is:

1. A toner comprising toner particles, each of which comprises a binder resin containing a polyester as a main component, a colorant, and a wax, wherein:

the binder resin comprises a block polymer in which a segment capable of forming a crystalline structure and a segment incapable of forming a crystalline structure are bonded, in measurement of the toner with a differential scanning calorimetry (DSC), a peak temperature of a maximum endothermic peak derived from the binder resin is at least 50° C. and not more than 80° C., and an endothermic quantity of the maximum endothermic peak is at least 30 J/g and not more than 100 J/g; and wherein:

the wax is an ester wax having 3 or more ester bonds as functional groups.

2. The toner according to claim 1, wherein a peak temperature of a maximum endothermic peak of the wax is 65° C. or more in measurement of the wax with a differential scanning calorimetry (DSC), and the wax has a saponification value of 160 mgKOH/g or more.

3. The toner according to claim 1, wherein the wax has a molecular weight of at least 1,500 and not more than 2,200.

4. The toner according to claim 1, wherein the wax is an ester wax having 6 or more ester bonds as functional groups.

5. The toner according to claim 1, wherein a content of the wax with respect to 100 parts by mass of the binder resin is at least 2.0 parts by mass and not more than 8.0 parts by mass.

6. The toner according to claim 1, wherein the segment capable of forming a crystalline structure in the block polymer is a crystalline polyester obtained by reacting an aliphatic dicarboxylic acid with an aliphatic diol.

7. The toner according to claim 1, wherein the segment incapable of forming a crystalline structure in the block polymer is a polyurethane obtained by reacting a diol with a diisocyanate.

8. The toner according to claim 1, wherein the block polymer contains, based on the total amount of the binder resin, at least 50 mass % and not more than 85 mass % of the segment capable of forming a crystalline structure.

9. The toner according to claim 1, wherein the toner particles are produced by a process comprising the steps of:

(i) preparing a dissolved material or dispersed material by dissolving or dispersing the binder resin, the colorant and the wax in an organic solvent;

(ii) preparing a dispersion by dispersing the dissolved material or the dispersed material in a dispersion medium containing carbon dioxide in a supercritical state or a liquid state where resin fine particles have been dispersed; and (iii) forming toner particles by removing the organic solvent from the dispersion.

* * * * *